US009827481B2

(12) United States Patent
Ritter

(10) Patent No.: US 9,827,481 B2
(45) Date of Patent: Nov. 28, 2017

(54) SPLITBOARD BOOT BINDING SYSTEM AND CLIMBING BAR COMBINATIONS

(71) Applicant: William J. Ritter, Bozeman, MT (US)

(72) Inventor: William J. Ritter, Bozeman, MT (US)

(73) Assignee: SPARK R&D HOLDINGS, LLC, Bozeman, MT (US)

( * ) Notice: Subject to any disclaimer, the term of this patent is extended or adjusted under 35 U.S.C. 154(b) by 0 days.

(21) Appl. No.: 15/009,604

(22) Filed: Jan. 28, 2016

(65) Prior Publication Data

US 2016/0199722 A1 Jul. 14, 2016

Related U.S. Application Data

(60) Provisional application No. 62/109,538, filed on Jan. 29, 2015.

(51) Int. Cl.
*A63C 9/10* (2012.01)
*A63C 9/00* (2012.01)
(Continued)

(52) U.S. Cl.
CPC ..... *A63C 9/10* (2013.01); *A63C 7/12* (2013.01); *A63C 9/003* (2013.01); *A63C 9/006* (2013.01);
(Continued)

(58) Field of Classification Search
CPC .. A63C 9/00; A63C 9/10; A63C 9/003; A63C 9/006; A63C 9/14; A63C 10/14;
(Continued)

(56) References Cited

U.S. PATENT DOCUMENTS 3,675,938 A * 7/1972 Sigl ..... A63C 9/006 280/607
4,513,988 A * 4/1985 Svoboda ..... A63C 9/006 280/615

(Continued)

FOREIGN PATENT DOCUMENTS

DE 9108618 1/1992
EP 0362782 B1 8/1992

OTHER PUBLICATIONS

Shoeboard Commercial Product—1 page description purportedly circa 2005, mini-ski binding with apparent adjustable toepiece and pivotable heel piece. Pivot located inferior to metatarsals at ball of foot. (as attested by B Kunzler Esq).

(Continued)

*Primary Examiner* — Brian Swenson
(74) *Attorney, Agent, or Firm* — Lambert Patent Services, LLC; Kal K Lambert

(57) ABSTRACT

A splitboard boot binding system with single multi-angle climbing wire. The pivotable climbing wire is configured for use with any compatible ski tour interface, and folds away under the boot binding baseplate when the bindings are transferred to a ride mode interface. In ski tour mode, the baseplate pivots on a toe axis and is supported by the climbing wire when the heel is raised. Advantageously, the climbing wire is very lightweight and seats interchangeably in a plurality of detent positions on a compatible heelblock. There are no interferences with conjoint use of a slide-in crampon seated between the heelblock and the toe pivot or with use in systems having a heel locker. Surprisingly, in some combinations the climbing wire may also be used to retain the slider track in ride mode. The combinations and sub-combinations require no tools for adjustment or operation and operate cooperatively.

26 Claims, 23 Drawing Sheets

(51) Int. Cl.
*A63C 7/12* (2006.01)
*A63C 9/02* (2012.01)
*A63C 10/04* (2012.01)

(52) U.S. Cl.
CPC ..... *A63C 9/02* (2013.01); *A63C 10/04* (2013.01); *A63C 2203/06* (2013.01)

(58) Field of Classification Search
CPC ..... A63C 10/145; A63C 10/18; A63C 10/28; A63C 7/00; A63C 7/005; A63C 7/10; A63C 7/12; A63C 5/02; A63C 5/03; A63C 2203/06
See application file for complete search history.

(56) References Cited

U.S. PATENT DOCUMENTS 4,635,955 A * 1/1987 Zoor ..... A63C 9/0807 280/614
4,718,694 A * 1/1988 Brice ..... A63C 7/005 280/605
5,076,604 A 12/1991 Wittman
5,114,172 A 5/1992 Rousset
5,984,324 A * 11/1999 Wariakois ..... A63C 5/02 280/14.24
6,431,578 B2 * 8/2002 Pedersen ..... 280/613
6,523,851 B1 * 2/2003 Maravetz ..... A63C 5/02 280/14.22
6,923,465 B2 * 8/2005 DuBuque ..... A63C 9/00 280/607
7,823,905 B2 11/2010 Ritter
8,191,918 B2 * 6/2012 Pupko ..... A63C 9/003 280/607
8,226,109 B2 7/2012 Ritter
8,328,225 B2 12/2012 Prigge
8,469,372 B2 6/2013 Kloster
8,714,578 B2 * 5/2014 Marechal ..... A63C 9/0807 280/607
9,022,412 B2 5/2015 Ritter
9,126,099 B2 9/2015 Ritter
9,220,968 B2 12/2015 Ritter
2004/0070176 A1 4/2004 Miller
2009/0179403 A1 * 7/2009 Ekberg ..... A43B 5/0403 280/623
2014/0210187 A1 7/2014 Ritter
2014/0274036 A1 * 9/2014 Fan ..... H04M 15/00 455/432.1
2015/0014962 A1 1/2015 Rayner
2016/0175685 A1 6/2016 Kloster
2016/0175690 A1 6/2016 Ritter

OTHER PUBLICATIONS

Shoeboard_BackPacking Light—1 page description dated 2006 from Back Packing Light On-Line product review.
Commercial Product Description—NITRO—Early splitboard distributed circa 1991-1993 by Nitro USA of Seattle WA; with Fritschi AT bindings and interface. Annotated photographs 1-10. Author: K Karel Lambert.
Voile Backcountry Ski and Snowboard Equipment 97-98. (Voile, Salt Lake City UT). (2 pages) paragraphs 4,5: "The slider tracks slide onto . . . ".
Nitro USA Snowboards Boardline 1993-1994 (Nitro USA, Seattle WA) (4 pages) p. 2 see photo, splitboard with ski-mode and snowboard-mode mounting assemblies, including slidably engageable conjoining bindings (see "Instruction for Use" attached below).
NitroUSA "Instructions for Use" (undated) p. 3 Riding position (Illustration [d]) ". . . slide the binding forward . . . ". Full text and illustrations.

* cited by examiner

TOP

BOTTOM

Fig. 11A
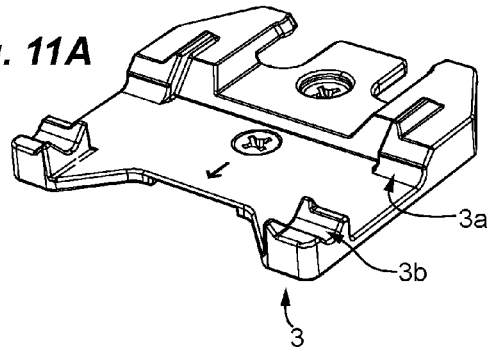
Fig. 11B
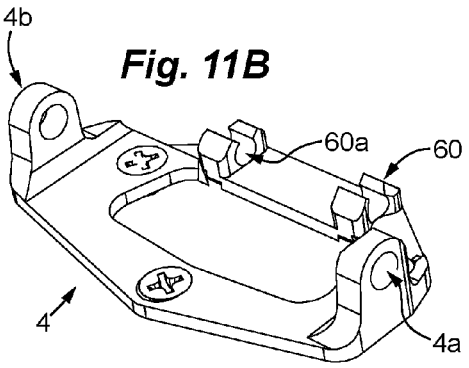
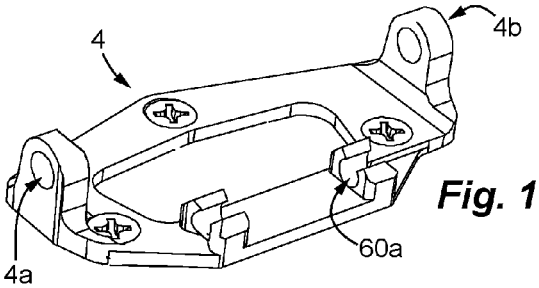
Fig. 11C
Fig. 11D
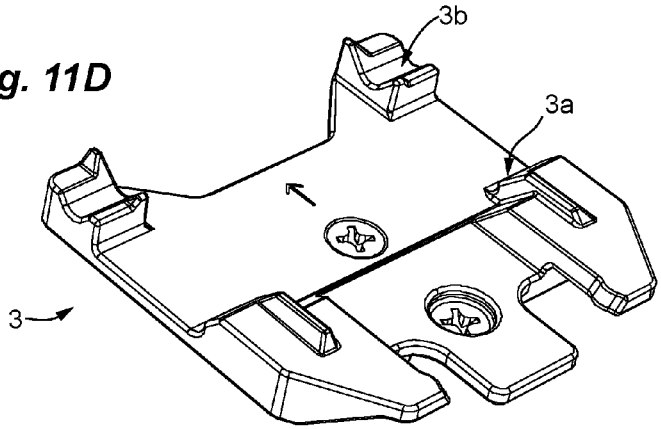

SPLITBOARD BOOT BINDING SYSTEM AND CLIMBING BAR COMBINATIONS

CROSS REFERENCE TO RELATED APPLICATIONS

This application is related to and claims the benefit of priority under 35 U.S.C. §119(e) to U.S. Provisional Patent No. 62/109,538, filed 29 Jan. 2015, which is herein incorporated in full by reference for all purposes. Also related are U.S. Pat. Nos. 7,823,905, 8,226,109, 9,022,412, 9,126,099, and 9,220,968, co-owned by the applicant, and US Pat Appl. Nos. 2014/0210187 filed 27 Dec. 2013, 2015/0246278 filed 4 Mar. 2015, U.S. patent Ser. No. 14/981,777 filed 28 Dec. 2015, and 62/099,364 filed 30 Nov. 2015, which are co-owned by the applicant. All said patent documents are herein incorporated in full by reference for all purposes.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The embodiments of the present invention relate to realizing an all-in-one splitboard boot binding system with multi-angle climbing wire, heel lock, crampon and heelblock with heel locking mechanism, and more particularly to a system of climbing wires having a plurality of pivot positions and a plurality of detent positions on a heelblock and/or on a crampon.

BACKGROUND

Backcountry skiers on alpine touring gear are able to move through snow with grace and ease. Surprisingly, using climbing wires and skins, the effortless fluid motions of cross country skiing also can be adapted to 'ski uphill'. The uphill ski technique has revolutionized the art, and is much less exhausting than hiking in deep snow. In contrast, a hiker must raise a boot above the snow for each step, only to sink in or slip when planting the boot for the next step—effort multiplied by thousands of steps. Combining alpine touring and snowboarding led to a whole new recreational sport, called "splitboarding", which allows the splitboarder to ascend the slopes on a pair of skis and then couple the ski halves together to form a solid board (resembling a snowboard) for the descent. Initially this innovation offered a way to reach backcountry mountains, where the snow was untracked; and for exploring the beauty and solitude of the wild upcountry. But as the sport has expanded, splitboards are also increasingly used at ski resorts "in-bounds" and where ski lifts are provided as many resorts now offer access to the backcountry where some kind of touring gear is needed. This popularity is because of their flexibility in alternating between a ski or touring mode and a snowboard descent mode and the availability of aids such as climbing skins.

While derived from snowboarding, the splitboarder has the option of being a snowboarder on the downhill or a skier for the uphill. The rider may disassemble the board and either carry the two ski halves or ski uphill to a backcountry destination; then reassemble the board halves and ride downhill in a generally side stance. Advantageously, in the splitboard riding mode the rider's legs are rigidly anchored together on the board, reducing the risk of knee injury associated with downhill skiing. Two boot binding interfaces are provided. A special "ski tour interface" is used for skiing. A "snowboard ride mode interface" is used when riding the board in its "solid board" or "snowboard" configuration (sometimes termed "descent mode").

Splitboards were first made by Ueli Bettenman, as described European Pat. Doc. Nos. CH681509, CH684825, German Gebrauchsmuster DE9108618, and EP0362782B1, first under the tradename Snowhow, and later in conjunction with Nitro (Seattle, Wash.). Another early entrant commercially was Voile (Salt Lake City, Utah). The popular "Split Decision" introduced a binding system essentially as described in U.S. Pat. No. 5,984,324 to Wariakois. The patent describes a "slider track" with insertable toe pivot pin for each foot, the slider track consisting of pairs of "slider blocks" mounted crosswise on each ski member for receiving a boot binding baseplate, the baseplate also serving as a pivot axle for "free heel" ski touring. This innovation resulted in substantial growth of interest in splitboarding in the United States and has had a worldwide impact on the sport. Ritter, in U.S. Pat. Nos. 7,823,905, 8,226,109, 9,022,412, and 9,126,099 discloses a stiffer, lower and lighter binding for spanning slider blocks mounted crosswise on the splitboard. These bindings are being commercialized by Spark R&D of Bozeman MT. However, substantial effort continues into packaging climbing wires, a heelblock, crampons, heel locking device, and other accessories into a boot binding baseplate that can be attached to a "ski touring" interface and yet is also compatible with a splitboard "ride mode" interface.

A solution to these and interrelated problems is only achieved by trial and error. Thus, there is a need in the art, for a climbing wire and heelblock assembly that overcomes the disadvantages of systems that require the rider to remove any cold weather gloves or break out a toolkit to make adjustments.

SUMMARY

Disclosed is a lightweight climbing wire and heelblock combination for a splitboard boot binding. The climbing wire is configured for use with any compatible heelblock of a ski touring mode interface, and folds away when the boot binding is transferred to a ride mode interface. The baseplate pivots on a toe pivot axle when the heel is elevated and supported by the climbing wire. A plurality of pivot positions and a plurality of detent positions are provided, allowing the rider a surprising degree of versatility in selecting a climbing inclination.

By using multiple detents for seating the climbing wire in a heelblock and optionally multiple climbing wire pivot axes on the outside walls of the baseplate, a fine level of control of the climbing angle is provided, as is advantageous in conserving strength when climbing. A goal of any splitboard boot binding system is an economy of effort in use, such that a rider may arrive at the top of a slope refreshed and fully charged for the enjoyment of a downhill run.

Advantageously, a crampon and a heel locker may also be incorporated without interference with the ride mode interface, an essential criterion in any splitboard boot binding. Also provided is a "snap ramp" for rapid exchange between the ride mode interface and the ski touring mode interface.

The elements, features, combinations, sub-combinations, steps, and advantages of the invention will be more readily understood upon consideration of the following detailed description of the invention, taken in conjunction with the accompanying drawings, in which presently preferred embodiments of the invention are illustrated by way of example.

It is to be expressly understood, however, that the drawings are for illustration and description only and are not intended as a definition of the limits of the invention. The various elements, features, steps, and combinations thereof that characterize aspects of the invention are pointed out with particularity in the claims annexed to and forming part of this disclosure. The invention does not necessarily reside in any one of these aspects taken alone, but rather in the invention taken as a whole.

BRIEF DESCRIPTION OF THE DRAWINGS

The teachings of the present invention are more readily understood by considering the drawings, in which:

FIGS. 11A, 11B, 11C and 11D are CAD perspective views of a toe pivot cradle or "bracket" and a heelblock with fasteners.

FIG. 24B shows a cross-sectional cut through the pucks at the cutline depicted in FIG. 24A.

Figure 1:
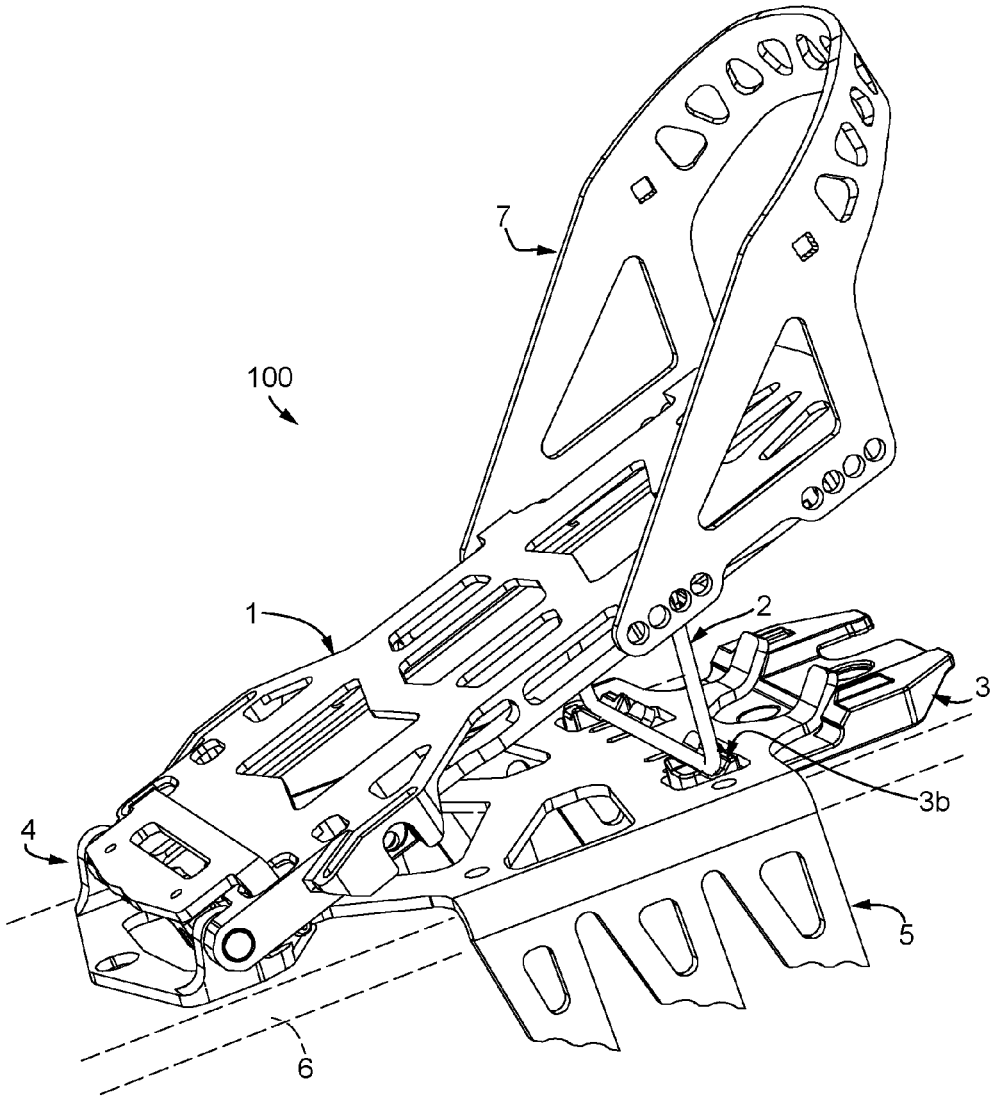
FIG. 1 is a CAD view of an exemplary pivotable splitboard boot binding with multifunctional accessories including climbing wire and crampon.

The drawing figures are not necessarily to scale. Certain features or components herein may be shown in somewhat schematic form and some details of conventional elements may not be shown in the interest of clarity, explanation, and conciseness. The drawing figures are hereby made part of the specification, written description and teachings disclosed herein.

GLOSSARY

Certain terms are used throughout the following description to refer to particular features, steps or components, and are used as terms of description and not of limitation. As one skilled in the art will appreciate, different persons may refer to the same feature, step or component by different names. Components, steps or features that differ in name but not in structure, function or action are considered equivalent and not distinguishable, and may be substituted herein without departure from the invention. Certain meanings are defined here as intended by the inventors, i,e., they are intrinsic meanings. Other words and phrases used herein take their meaning as consistent with usage as would be apparent to one skilled in the relevant arts. The following definitions supplement those set forth elsewhere in this specification. Unless otherwise defined, all technical and scientific terms used herein have the same meaning as commonly understood by one of ordinary skill in the art to which this invention belongs, but in case of conflict, the present specification, including definitions, will control.

Splitboard: a combination consisting of two separable ski members, each generally having one non-linear ski-like longitudinal edge, that can be conjoined at opposing lateral straight edges (defining a board "seam") to form a snowboard. The ski members are typically shaped so as to approximate the right and left halves of a snowboard respectively. The tips of the ski members are generally secured together in the snowboard configuration by use of hooks, pins, or other conjoining apparatus, but the relative stiffness of the coupling is largely the result of the mechanics of the transverse union formed by the boot bindings and associated hardware straddling the separate ski members.

A ski mode interface is an assembly affixed to a gliding board, the interface having a toe pivot bracket or cradle for pivotably mounting a boot binding thereon. The ski mode configuration is used for ski touring and cross-country.

A ride mode interface, also termed a "snowboard riding interface" or "descent mode interface" is an assembly affixed to a gliding board so that a rider can ride downhill with legs spread and body generally in a side stance on the board. The interface is used when the board is ridden in the manner of a snowboard. These interfaces may optionally comprise paired members, such that one member of each pair is affixed to one half of a gliding board, so that when each of a rider's boot bindings are engaged thereon, the halves of the gliding board are joined to each other.

"Ride" or riding: a noun or verb used by snowboarders to indicate the distinctive downhill slide experienced by a rider on a snowboard (or on a splitboard in snowboard mode). Snowboarders ride; skiers ski.

Ski tour or touring: When used as a noun, indicates: a trip through areas typically away from ski resorts, referred to as the backcountry, which may include traversing flat areas, ascending inclined slopes and descending slopes using one or several of the following pieces of equipment: skis, poles, snowshoes, snowboards, or splitboards. When used as a verb, indicates: to enter the backcountry, typically away from a ski resort, and perform one or more of the following: traverse flat areas, ascend inclined slopes, and descend slopes using one or more of the following pieces of equipment: skis, poles, snowshoes, snowboards, or splitboards.

Ski touring configuration or mode: indicates a configuration in which the two ski members are separate and are attached one to a leg, typically with a free heel binding to facilitate traversing terrain and ascending slopes. When used to describe a splitboard configuration, indicates that the ski halves have been separated and the rider is ski touring on the separate ski members attached to each foot.

Ski mounting assembly or "ski mounting interface": refers to hardware, brackets, pins or blocks secured on the surface of each ski, generally centrally placed, so that boot bindings can be fastened to them, one boot to a ski, in the ski touring mode or position. In the most common conventional device, a ski touring pin cradle is used with a pivot pin or pins with the pivot axis extending through the toe of an adaptor mounting plate, the purpose of which is to provide a pivotable coupling between the boot binding and its counterpart ski member, as in telemark skiing and "free heel" skiing. A ski mounting block may take the place of the pin cradle and may be used with boot mounting tongues, cables, or other pivoting means. Bushings may be used to extend the life of the wearing surfaces. Incorporated herein by reference with respect to pivoting means are U.S. Pat. No. 5,649,722 to Champlin, U.S. Pat. No. 6,685,213 to Hauglin, U.S. Pat. No. 5,741,023 to Schiele, U.S. Pat. No. 5,984,324 to Wariakois, U.S. Pat. No. 7,823,905 to Ritter, U.S. Pat. No. 8,226,109 to Ritter, US Pat. Appl. 2005/0115116 to Pedersen, US Pat. Appl. 2013/025395 to Ritter, and their cited references. As described herein, a webbed girder construction of the boot binding beam permits use of a longer pivot pin with less wear. Snowboard riding configuration or mode: indicates a configuration in which the right and left ski members are joined at opposing lateral edges to form a snowboard and the rider mounts the board with both feet spaced and secured in the mounting block assemblies.

Snowboard mounting block assembly or "mounting block assembly": refers to a pair of flanged mounting block elements (also termed "slider blocks" in the prior art or simply "mounting blocks" here) secured to the ski members of a splitboard so that they can be conjoinedly and flangedly interlocked in the snowboard configuration. For example, the mounting block assemblies (FIG. 2 and FIG. 3), as illustrated here, are representative of the prior art (See U.S. Pat. No. 5,984,324), but are not limited to such. In practice, paired pucks are proximately positioned on the opposing ski members, forming a "slider track" to receive a boot binding baseplate traversing and joining the two ski members into a rigid solid board for the downhill ride.

"In alternation" or "in turn" refers to the interchangeability of the boot binding system between a ride mode interface and a ski touring mode interface, but may also include switching the system from one gliding board to another board having a compatible interface. Thus any combination of interfaces may be selected in turn because the engagement mechanisms enable attachment to any of them.

General connection terms including, but not limited to "connected," "attached," "conjoined," "mounted", "secured," and "affixed" are not meant to be limiting, such that structures so "associated" may have more than one way of being associated.

Relative terms should be construed as such. For example, the term "front" is meant to be relative to the term "back," the term "upper" is meant to be relative to the term "lower," the term "vertical" is meant to be relative to the term "horizontal," the term "top" is meant to be relative to the term "bottom," and the term "inside" is meant to be relative to the term "outside," and so forth. Unless specifically stated otherwise, the terms "first," "second," "third," and "fourth" are meant solely for purposes of designation and not for order or for limitation. Reference to "one embodiment," "an embodiment," or an "aspect," means that a particular feature, structure, step, combination or characteristic described in connection with the embodiment or aspect is included in at least one realization of the present invention. Thus, the appearances of the phrases "in one embodiment" or "in an embodiment" in various places throughout this specification are not necessarily all referring to the same embodiment and may apply to multiple embodiments. Furthermore, particular features, structures, or characteristics of the invention may be combined in any suitable manner in one or more embodiments.

It should be noted that the terms "may," "can," and "might" are used to indicate alternatives and optional features and only should be construed as a limitation if specifically included in the claims. The various components, features, steps, or embodiments thereof are all "preferred" whether or not specifically so indicated. Claims not including a specific limitation should not be construed to include that limitation. For example, the term "a" or "an" as used in the claims does not exclude a plurality.

"Conventional" refers to a term or method designating that which is known and commonly understood in the technology to which this invention relates.

Unless the context requires otherwise, throughout the specification and claims that follow, the term "comprise" and variations thereof, such as, "comprises" and "comprising" are to be construed in an open, inclusive sense—as in "including, but not limited to."

The appended claims are not to be interpreted as including means-plus-function limitations, unless a given claim explicitly evokes the means-plus-function clause of 35 USC §112 para (f) by using the phrase "means for" followed by a verb in gerund form.

A "method" as disclosed herein refers to one or more steps or actions for achieving the described end. Unless a specific order of steps or actions is required for proper operation of the embodiment, the order and/or use of specific steps and/or actions may be modified without departing from the scope of the present invention.

DETAILED DESCRIPTION

Referring to FIG. 1, a CAD view of an exemplary combination 100 including boot binding baseplate 1 with climbing wire 2, heelblock 3 and pivotable crampon 5 is shown. Also shown is a toe pivot bracket or "cradle" 4 with a pedal-operated locking mechanism, sometimes termed a "snap ramp", generally as disclosed in U.S. Pat. No. 9,126,099, titled BOOT BINDING SYSTEM WITH FOOT LATCH PEDAL, which is co-owned and co-assigned. Advantageously the climbing wire 2, heelblock 3 and crampon 5 are compatible with the paired toe pintle pin mounting system described in the '099 patent application, which is incorporated here in full for all it teaches, but the mechanism of the toe pivot is not limited thereby. Most conventional toe pivot brackets and axles may be adapted to gain from the teachings disclosed here. Alternate toe pivot means suitable for use with the inventive combination include without limitation, U.S. Pat. No. 5,649,722 to Champlin, U.S. Pat. No. 6,685,213 to Hauglin, U.S. Pat. No. 5,741,023 to Schiele, U.S. Pat. No. 5,984,324 to Wariakois, U.S. Pat. No. 7,823,905 to Ritter, U.S. Pat. No. 8,226,109 to Ritter, US Pat. Appl. 2005/0115116 to Pedersen, US Pat. Appl. 2013/025395 to Ritter, and their cited references.

The exemplary pivotable splitboard boot binding is characterized by combinations with multifunctional accessories including a single climbing wire 2 and a crampon 5 configured to support three angulations of the boot binding baseplate 1 in combination with the crampon and three angulations (including a neutral position) without the crampon. Previous efforts had centered on multiple climbing wires or "climbing bars" of different lengths, sometimes affixed to a heelblock, sometimes to a baseplate, but the improved single climbing wire disclosed here achieves multiple angulations with reduced weight and allows room for a heel locking mechanism and a pivotable crampon. Unexpectedly, in this configuration, the climbing wire may also serve a novel function: to restrain the baseplate at the heel end of the slider track in ride mode. Optional combinations include a heel locking mechanism as described in U.S. Pat. No. 9,220,968 to Ritter, titled HEEL LOCK FOR SPLITBOARD BINDING INTERFACE, which is co-owned and co-assigned, and is incorporated here in full for all it teaches.

These multifunctional capabilities are achieved by structural modifications of a baseplate 1, a toe pivot cradle 4 and a heelblock 3 so as to make use of the very limited residual space under the baseplate, as will be described in more detail below. Briefly, the crampon 5 hingedly connects to the toe pivot cradle 4 and engages the heelblock 3; the climbing wire 2 depends from the baseplate 1 and engages detents on the heelblock 3 and the crampon 4, and the baseplate 1 reversibly pivots in the toe pivot cradle 4. Thus the parts structurally interconnect and operationally interact with each other to produce the desired range of functions and adjustments in the space available. Each is removable or stowable depending on conditions, or as the bindings are exchanged between a ski tour interface and a ride mode interface as unique to splitboards. Each part connects to or engages the toe pivot bracket and/or the heelblock, which are permanently fastened, one each, to each ski half 6 of the splitboard. The ski tour interface is used in ski touring mode, for cross-country skiing, and for skiing uphill with skins, for example. Also shown is a "heel cup" or "heel loop" 7 used in securing a boot to the baseplate.

In this instance, the climbing wire 2 is shown in a fully raised position and is mounted on a detent 3*b* in the heelblock 3, shown here protruding through a "saddle" of the crampon 5 that seats on the ski. Straps, a highback, and other conventional mounting hardware are not shown for clarity.

Figure 2:
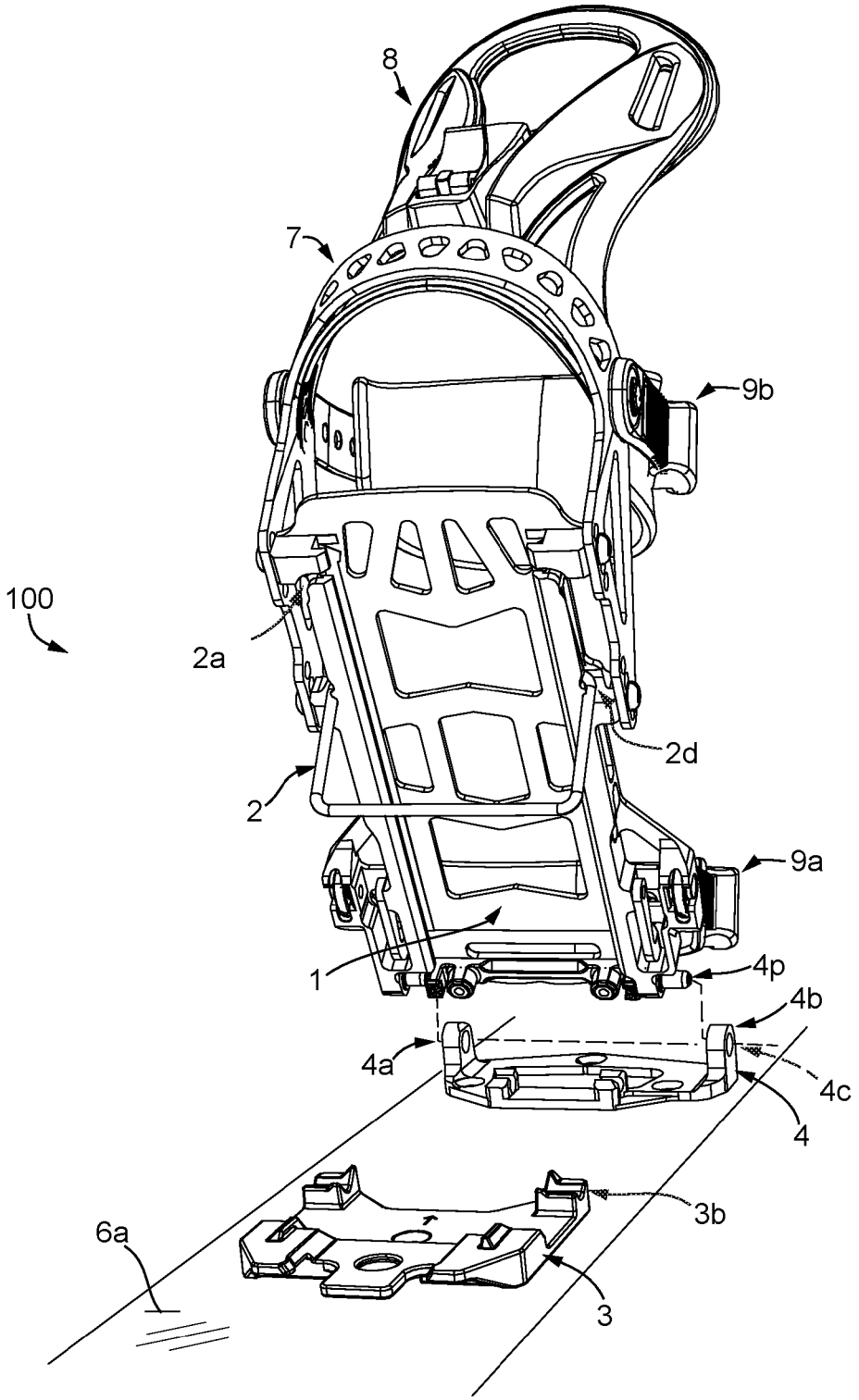
FIG. 2 is a perspective composite view of a ski tour interface and splitboard binding combination with climbing wire deployed.
Figure 3:
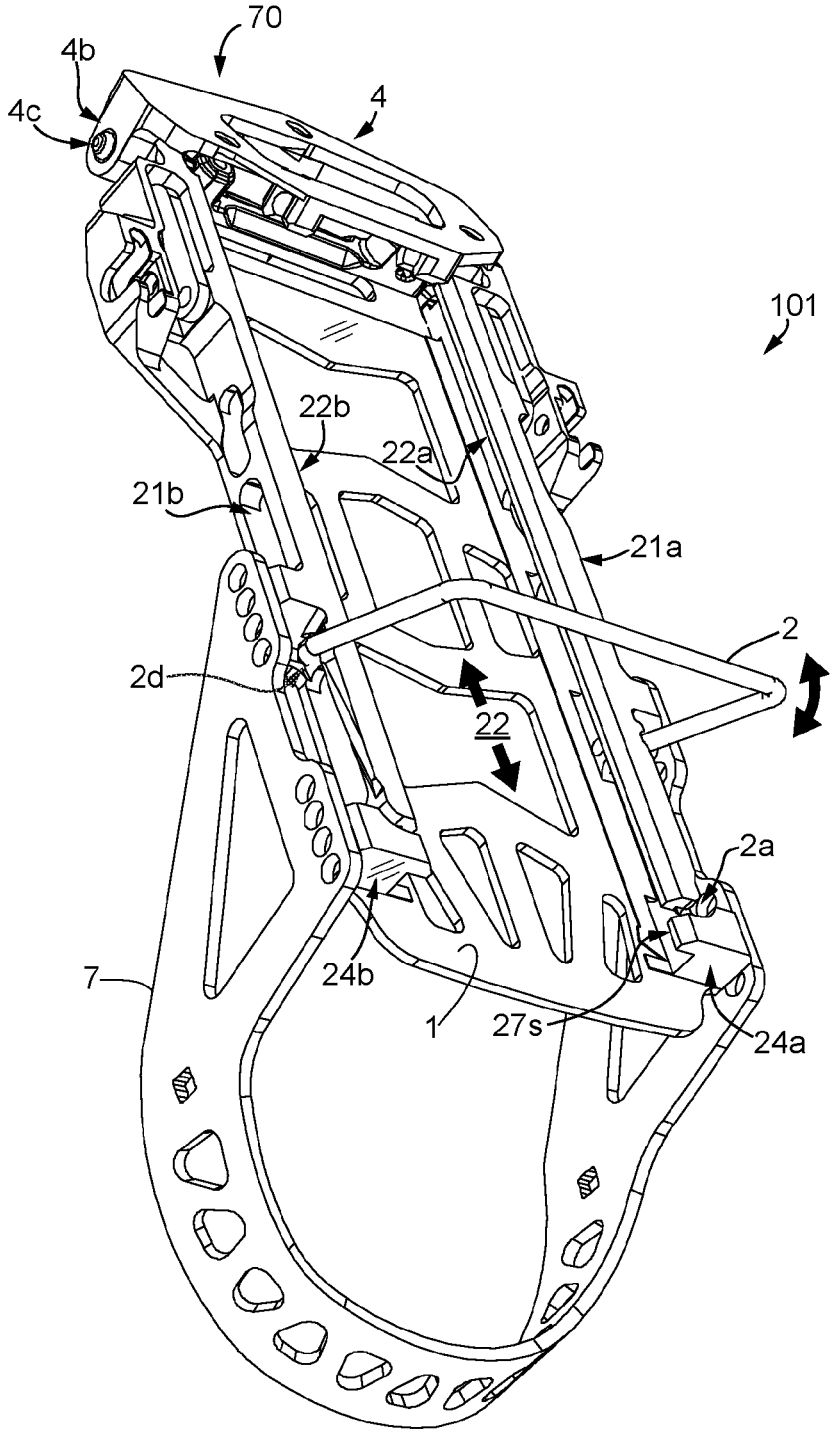
FIG. 3 illustrates the pivot action of the climbing wire as hinged to the underside of the boot binding baseplate, shown here with toe pivot.

FIG. 2 is a perspective underside view of a splitboard tour interface and boot binding combination 100 with pivotable baseplate 1, toe pivot cradle 4, heelblock 3, and stowable climbing wire 2 in a deployed (i.e., raised) configuration. While not shown, the combination is also configured to receive a hinged crampon between the toe pivot cradle and the heelblock, which are fastened to the surface 6*a* of the ski member. Here, also shown is a heel cup 7 with highback 8 and toe and ankle straps (9*a*,9*b*). The view illustrates "free heel" ski touring mode, in which the baseplate pivots on toe pivot axis 4*c*. In this end perspective view, the baseplate 1 is raised to allow a close-up view of the heelblock 3, toe pivot cradle 4, and climbing wire mount 2*d*. The toe pivot mechanism is shown to have a toe pivot pin 4*p* that inserts into toe pivot ears (4*a*,4*b*) and pivots on toe pivot axis 4*c*. FIG. 3 illustrates the pivot action of an exemplary climbing wire 2 as hinged to the underside of a pivotable boot binding baseplate, shown here with toe pivot bracket 4, illustrating the pivot action of the climbing wire as hinged to the boot binding baseplate at climbing wire mount 2*d*. In use, the climbing wire would be standing on the heelblock or on detent or receiving surfaces of the crampon. Also illustrated are interconnected components of the combination 101, including heel loop 7, baseplate 1, toe pivot cradle 4, toe pivot ears (4*a*,4*b*), toe pivot axis 4*c*, and toe latch pedal mechanism 70.

The climbing wire 2 is "U-shaped" having two legs (each leg is disposed to pivot from the underside of the baseplate) and a horizontal "base segment" that rigidly joins each leg at the foot, such that the base segment of the wire rests on the heelblock or crampon. Advantageously, the heelblock avoids the need to rest the climbing wire directly on the ski member surface, and the detent stops prevent unwanted slippage and increase the overall elevation achieved.

The climbing wire is selected and treated to have a modulus of elasticity, and can be springedly pinned in place by use of small detent concavities or teeth, such as at the upper bent tips that engage the walls of the underside lateral truss beam members (21*a*,21*b*). Also shown is the toe pivot cradle. The heelblock is not shown for clarity of mount mechanism 2*d*. Internal center channel space 22 is marked with a double headed bold arrow. Two "truss beams" (21*a*, 21*b*) and "flanged walls" (22*a*,22*b*) define the internal puck-receiving channel. But they do much more. Both are continuous from front to rear of the binding and are extensively adapted in support of advanced functions such as strap mountings, flange end stop fittings, climbing wire supporting member, toe pivot ear support and heel engagement. End stop flanges (24*a*,24*b*) are mated to corresponding flats on the heelblock and are flush fit.

Climbing wire 2 is received in a stowage channel 2*a* nested in the lateral truss beams of the baseplate. Hooked pins formed in the climbing wire allow the wire to pivot at 2*d* in pivot holes in the truss beams. The base of the climbing wire is held in a detent at channel 2*a*. The channel bisects the internal flanged wall 22*b* and end stop flanges 24*b* of the beams. Flange projections 27*s* serve in a heel locking combination described below. The climbing wire is held in place by spring tension and is readily deployed from the stowage channel 2*a*, such as with a ski pole.

Figure 4B:
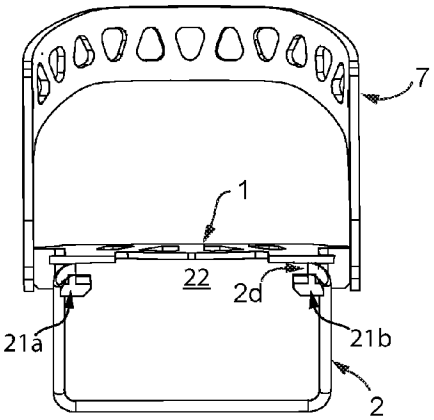
FIGS. 4A, 4B, 4C, and 4D are views depicting details of an exemplary climbing wire as mounted under the baseplate.
Figure 4D:
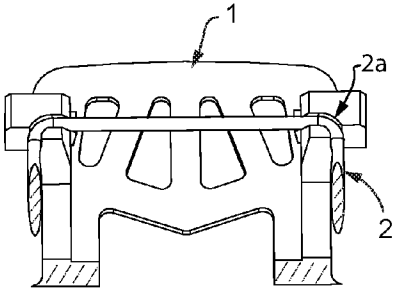
Figure 4C:
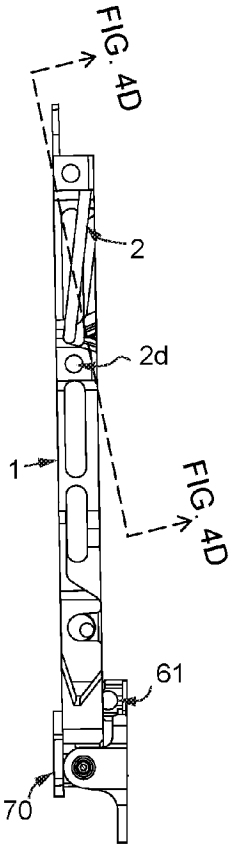
Figure 4A:
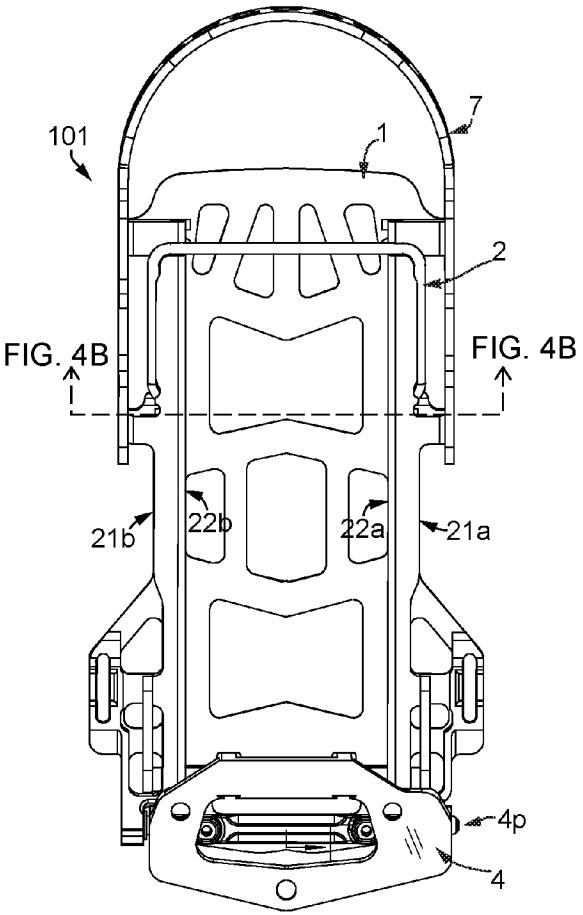

FIGS. 4A, 4B, 4C, and 4D are views depicting details of exemplary climbing wire combination 101 as mounted under the baseplate 1. FIG. 4A shows an underside view with climbing wire 2 in its stowage channel and the mounting plate of the toe pivot mechanism 4 with toe pivot pin 4*p*. Also shown are contralateral truss beams (21*a*,21*b*) with internal flanged walls (22*a*,22*b*). The plane of cross-section for FIG. 4B is drawn as a dashed line. FIG. 4B is an isometric view which shows the baseplate with supporting lateral truss beams (21*a*,21*b*) and inside flanges. The climbing wire 2 is bent so as to be inserted into a pivot hole at its mounting station 2*d* in the truss and is shown here as deployed in a standing position. FIG. 4C is an elevation view of the baseplate and toe pivot mechanism 70. Visible is the hinge claw bracket 61 for mounting the slide-in crampon immediately behind the toe pivot ears. Also shown is an oblique cross-section plane for FIG. 4D, drawn as a dashed line. The cutline transects the climbing wire as shown in FIG. 4D, isolating the base of the climbing wire as nested in its stowage channel 2*a* at the heel end of the baseplate in its neutral detent position (i.e., undeployed). For deployment, the climbing wire is freed from the neutral detent position with a push from a ski pole and will pivot on the hooked pivot pins of its mounting station 2*d* and click lock into one of the raised positions as described more completely with reference to FIGS. 13A-13C and 14A-14C inclusively. FIG. 4B also shows that the climbing wire does not interfere with the underside channel 22, but when stowed, blocks the heel end of the channel so as to trap the pucks of the ride mode interface, and will be described in more detail in FIGS. 24B and 24C.

Figure 5:
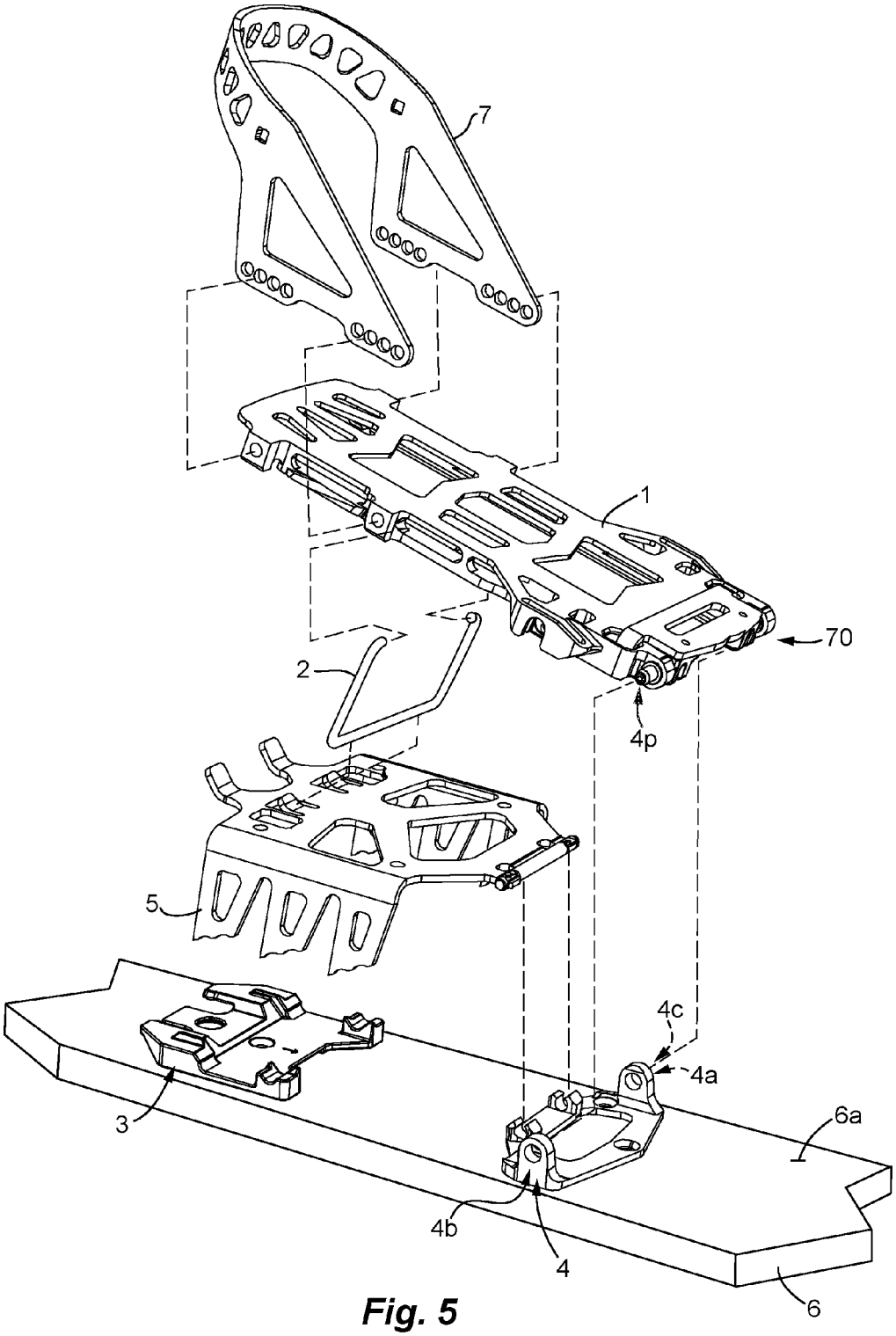
FIG. 5 is an exploded view of a combination splitboard boot binding assembly with exemplary climbing wire, pivotable crampon, heelblock, and pivotable binding baseplate.

FIG. 5 is an exploded view of an exemplary splitboard boot binding and ski tour mode interface assembly. The pivotable splitboard boot binding baseplate 1 is fitted with a "U-shaped" climbing wire 2. Shown are heel loop 7 and toe latch pedal mechanism 70 with prominent toe pivot pins 4*p*. The ski tour interface is modified with a heelblock 3, toe pivot cradle 4, toe pivot ears (4*a*,4*b*), toe pivot axis 4*c*, and pivotable crampon 5. Toe pivot axis 4*c* joins the toe pivot cradle and pivotable baseplate. While conventional toe pivot axles that are generally rod shaped may be used to form a pivot axis, in this instance, pintel pins 4*p* are used. Threaded fasteners are used to attach the toe pivot cradle and heelblock to the surface 6*a* of the ski member, and to attach the heel loop 7. All other components of the combination shown are mounted without additional fasteners.

Figure 6:
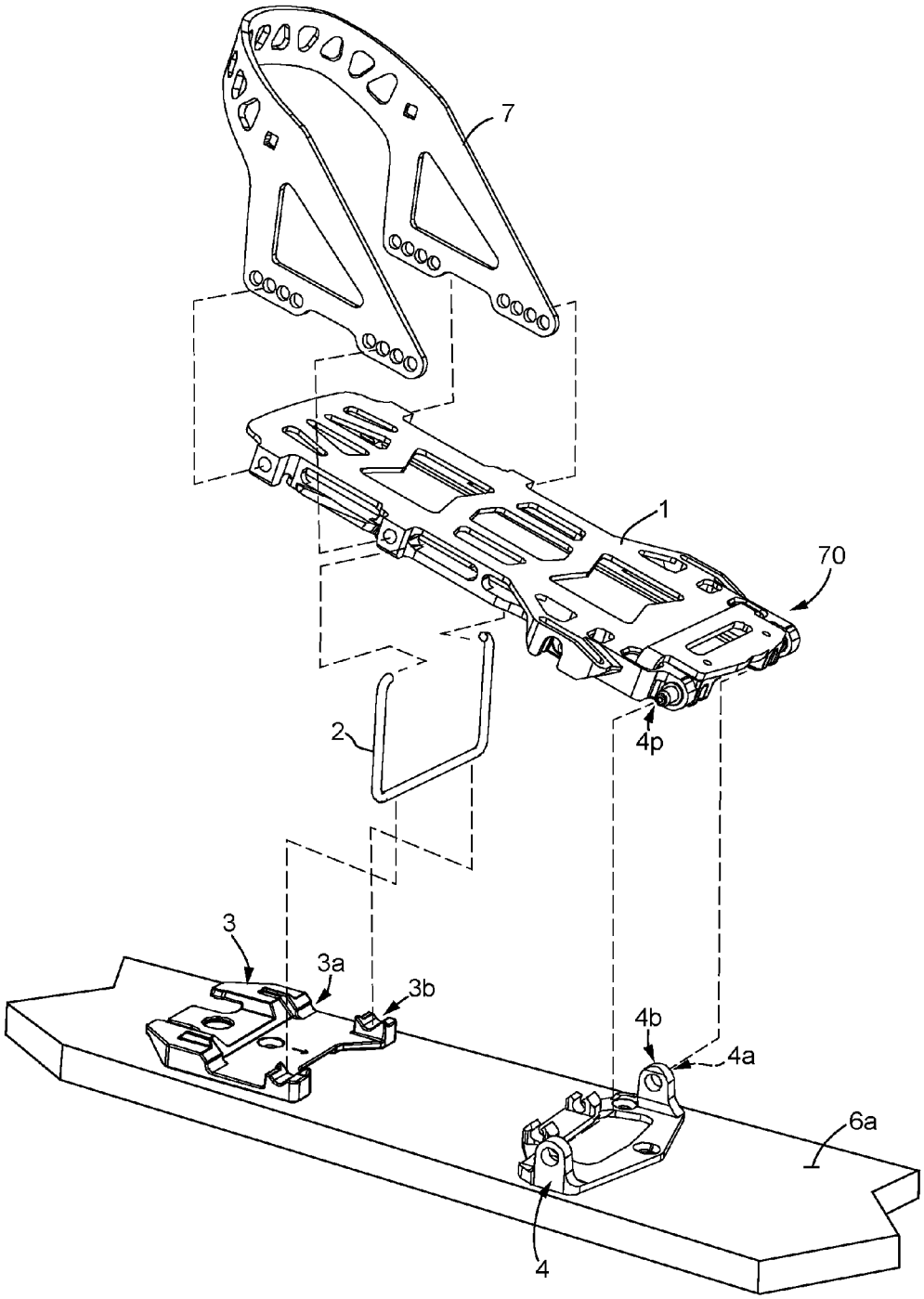
FIG. 6 is an exploded view of a combination splitboard boot binding assembly with exemplary climbing wire and heelblock.

FIG. 6 is an exploded view of a splitboard boot binding and ski tour interface assembly with exemplary climbing wire and heelblock. The assembly is shown with baseplate 1 in an upright angulation relative to toe center pivot axis 4*c* and toe pivot ears (4*a*,4*b*), with climbing wire 2 seated in a second detent station 3*b* on the top surface of the heelblock 3. The climbing wire, heelblock, and baseplate define multiple geometries. Detents (3*a*,3*b*) may be positioned and act cooperatively with the single climbing wire to rigidly raise the baseplate to any acute, right or obtuse triangular configuration that proves useful. This eliminates the need for multiple climbing wires and complex disassembly to adjust angulation of the baseplate.

Figures 7, 7I:
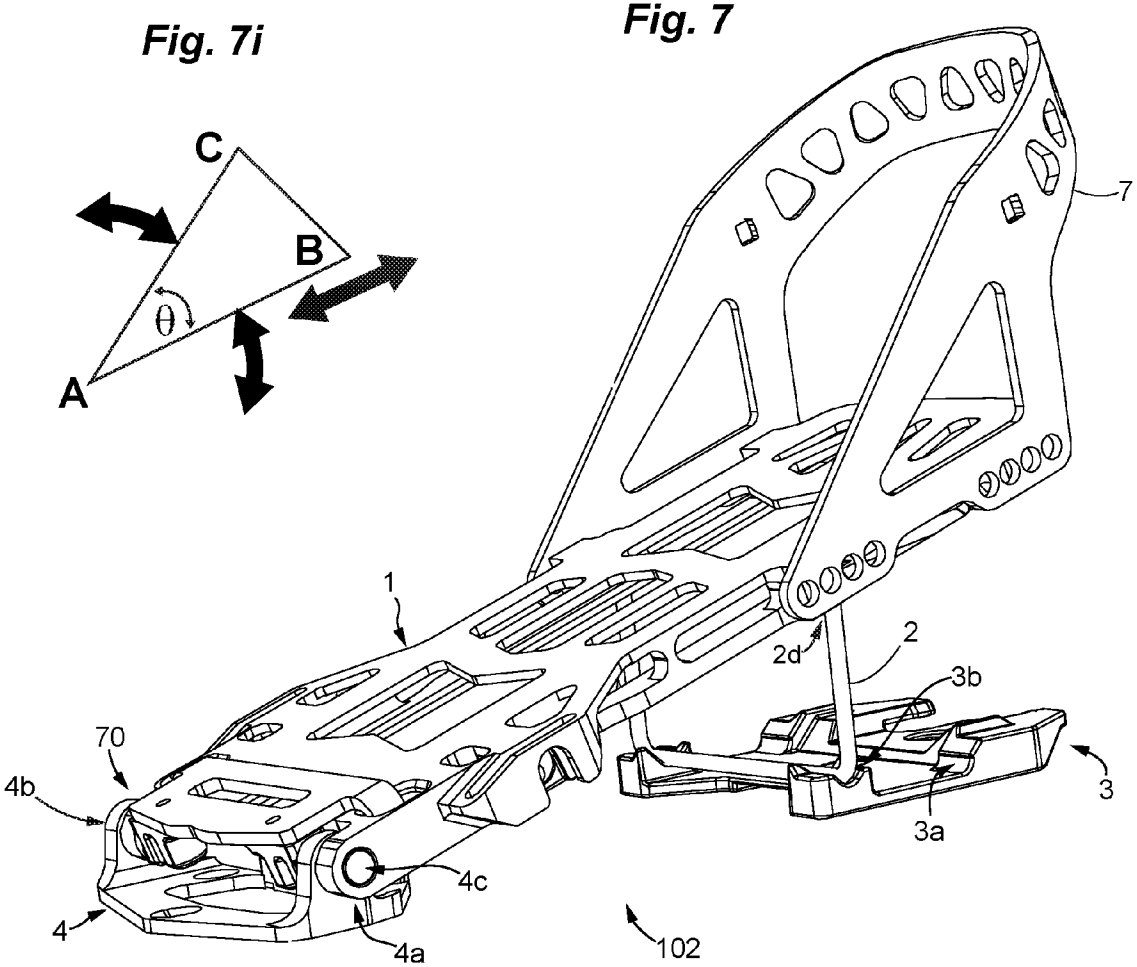
FIG. 7 is a perspective view of an elevated baseplate and climbing wire seated in a detent station in the heelblock.
FIG. 7*i* is a schematic representation of the geometry.

FIG. 7 is a perspective view of an elevated baseplate 1 and climbing wire 2 seated in a detent station in the heelblock 3. This splitboard boot binding baseplate combination 102 is shown with baseplate in an upright pivot angulation relative to toe center pivot axis 4*c* and toe pivot ears (4*a*,4*b*), with climbing wire 2 seated in a second detent station 3*b* on the top surface of the heelblock 3 of the ski touring interface. Use of a single climbing wire is a substantial improvement over multiple climbing wires, either those mounted on a heelblock or those dependent from a pivot mount in the baseplate. Multiple detents are needed to generate multiple angles, but these are provided in the surface of the heelblock 3: which becomes a hard platform for seating the climbing wire in one or more detent positions. In use, the rider will readily lean forward and accelerate, and in fact the climbing wire may rise out of the standing detent 3*b* (second detent). However, on flattening out, the precision device returns to its supporting detent position at 3*b* until the rider disengages it by hooking it with the basket of a ski pole and moving it to its stowage channel, or sets it into the lower, first detent position 3*a* on the heelblock.

Figuratively, operation of the climbing wire is represented in FIG. 7*i*. Point A represents the toe pivot cradle axis 4*c*, point B represents the base length between the toe pivot cradle and the detent stop in use (3*b*), and point C represents the height of the baseplate at climbing wire mount 2*d*. Triangle base segment A-B may be varied in length; thus the angulation theta (θ) at A is selectable over a range corresponding to the length of and angle of the climbing wire as indicated by the bold arrows. No tools are needed to make adjustments. For example, when strapped in, the rider can reach back and use a ski pole to adjust the heel angle by repositioning the climbing wire from one detent to another.

Figure 8A:
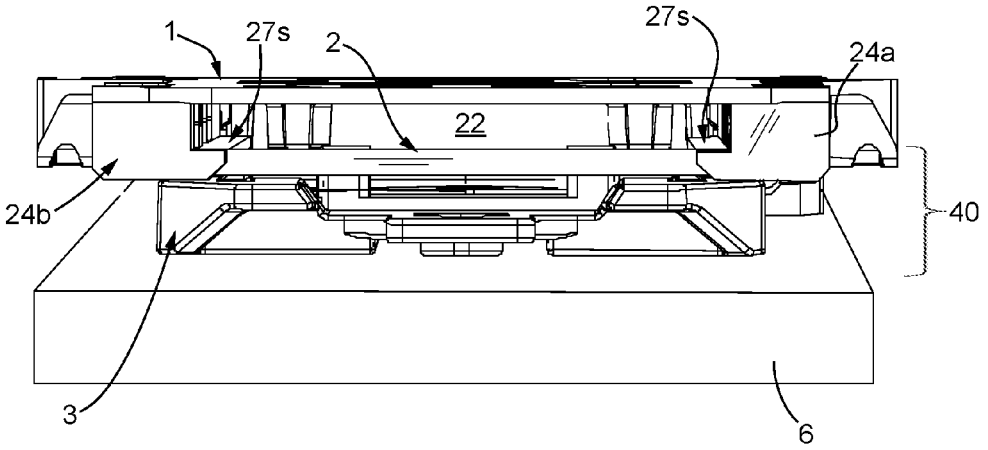
FIGS. 8A and 8B are rear views of a splitboard boot binding demonstrating available clearance for accessories.
Figure 8B:
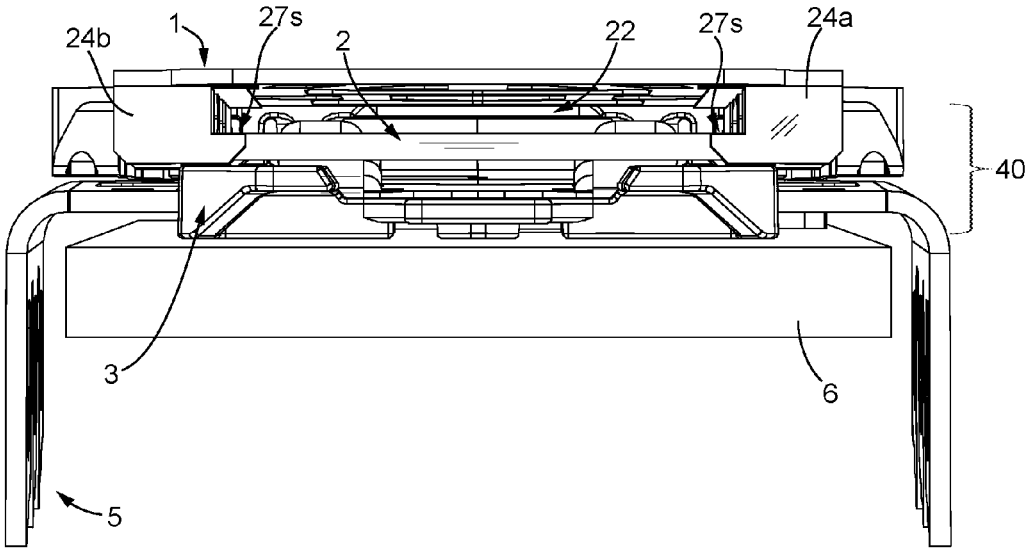

FIGS. 8A and 8B are rear views of a splitboard boot binding demonstrating available clearance 40 for accessories. The underside clearance 40 as defined by the underside center channel space in the drawings, which occupies a thin opening between the layers of the top ski surface 6*a* and the lateral and vertical dimensions of the underside channel 22 defined in the baseplate 1 between flanged inside walls that terminate at the heel end in flanged end stops (24*a*,24*b*).

In these end perspective views, the ski member is truncated to allow a close-up view of the heel of the baseplate and pivot mechanism, including climbing wire 2 disposed above the heelblock 3 and a crampon 5 saddled on the ski member 6. As the baseplate is lifted at the heel, the accessory functions of the climbing wire and crampon become accessible. Also shown in this view is climbing wire 2, as secured in a stowage groove in the end stop flange members (24*a*, 24*b*). A similar view is provided in FIG. 8B, but with a crampon 5 in place.

All the accessories must be compatible with the limited underside clearance [i.e., under the baseplate as shown here, and in FIGS. 2 and 3]. Splitboarding is defined by the capacity to alternate in turn between a ride mode interface and ski tour mode interface, thus the available freespace for accessories used in ski tour mode is limited by the space needed to accommodate pucks of the ride mode interface without the need to disassemble or remove the climbing wire(s) 2 or any other accessories that are installed permanently or semi-permanently in association with the heelblock 3, the toe pivot cradle 4, or the baseplate 1. Only the heelblock and the toe pivot cradle or "bracket" is actually affixed to the board, minimizing invasive use of fasteners and reducing weight. The baseplate underside clearance is approximately a centimeter or so, and is limited by toe pivot ears and a toe pivot mechanism in the front and by the heelblock in the rear. Thus the heelblock serves as a toolbox with a reinforced platform surface. Most of the space under the baseplate is dedicated to receiving and grippingly conjoining the interior underside flanges with mating flanges on the pucks in ride mode, so considerable effort was needed to devise solutions for the ski tour mode that optimized cooperative interactions between the constituent parts, so that all can be operated in any possible combination interchangeably. Each combination may be termed a sub-combination.

Also shown in FIG. 8A, is a shelf 27*s* formed on end stop flanges (24*a*,24*b*) that functions for capture of the baseplate in "fixed heel mode". The pivot action of the baseplate may be restricted by the action of a heel locker mechanism. As will be shown in later views, the heel locker mechanism may be built into the heelblock 3.

Figure 9A:
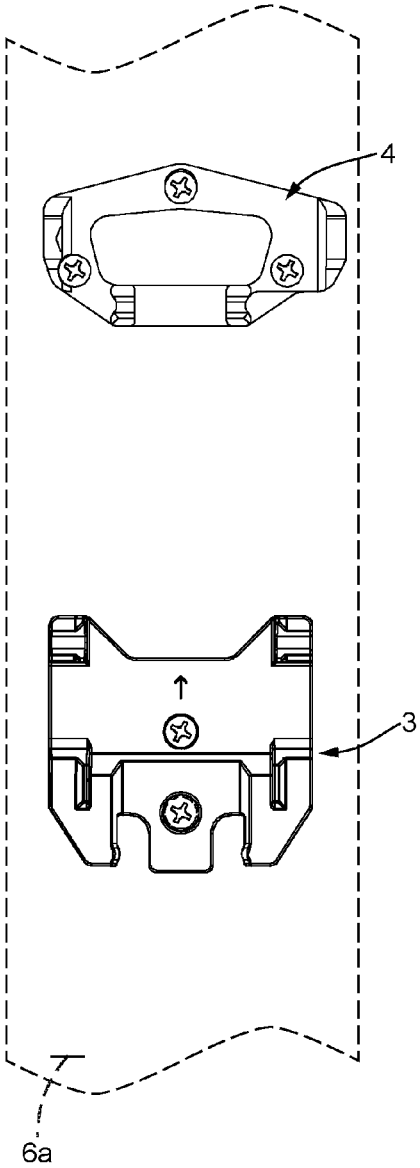
FIGS. 9A and 9B depict the layout of a ski tour interface with a toe pivot cradle and a heelblock attached to a half-ski member of a splitboard.
Figure 9B:
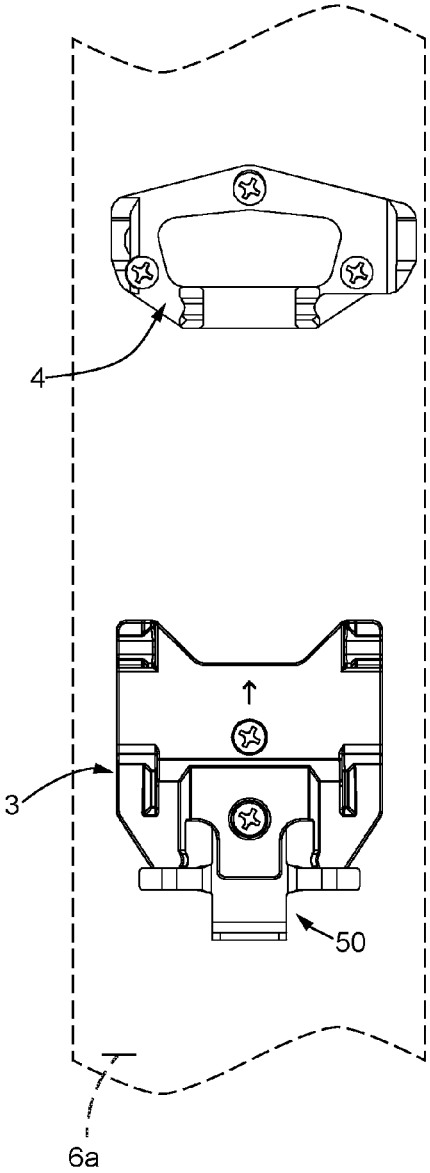

FIGS. 9A and 9B depict the layout of a toe pivot cradle 4 and a heelblock 3 of a ski tour interface attached to a top surface 6*a* of a half-ski member of a splitboard. Also shown in FIG. 9B is a slideable heel locker 50 used in some combinations of the ski tour interface.

Figure 10A:
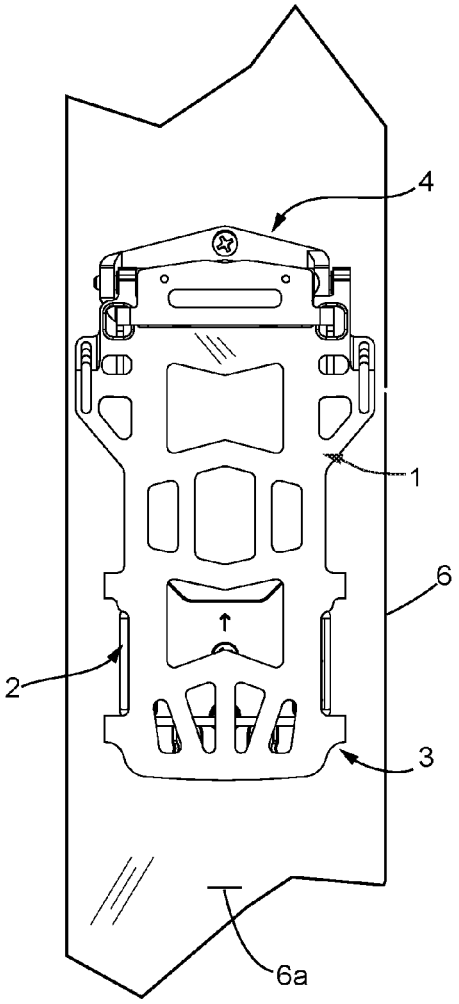
FIGS. 10A and 10B are top plan view and bottom plan view of a multifunctional splitboard boot binding combination with ski tour interface.
Figure 10B:
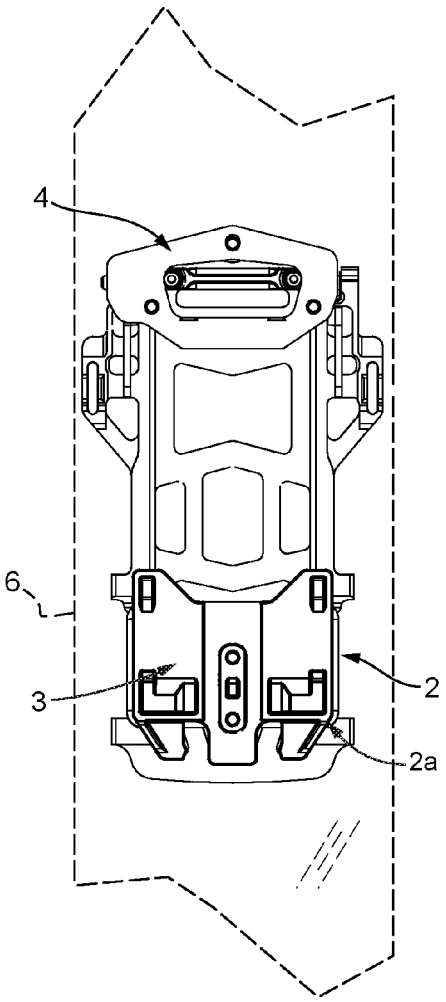

FIGS. 10A and 10B are top plan view and bottom plan view of a multifunctional splitboard boot binding combination with ski tour interface. The leftmost figure shows a top down view of the baseplate 1 with toeward end at top and heelward end at bottom. Also visible are the toe pivot cradle 4 and part of the climbing wire 2. The heelblock is visible in part through fenestrations in the baseplate. FIG. 10B exposes the underside of the binding system (as if seen through a transparent ski), showing the underside of the toe pivot cradle 4, the underside of the heelblock 3, and the climbing wire 2 in part, which is nested in a stowage channel 2*a* at the heel end of the baseplate.

FIGS. 11A, 11B, 11C and 11D are CAD perspective views of a toe pivot cradle or "bracket" 4 and heelblock 3 with fasteners used to secure the pieces to the surface of a ski tour interface. The toe pivot cradle includes toe pivot ears 4*a* and 4*b* forming a toe pivot axis, and a crampon hinge bracket 60 with a pair of hinge claws 60*a* for capturing a hinge axle of the crampon, as will be shown below. Structural details of the molded top platform of the heelblock include a pair of detents (3*a*,3*b*).

Figure 12A:
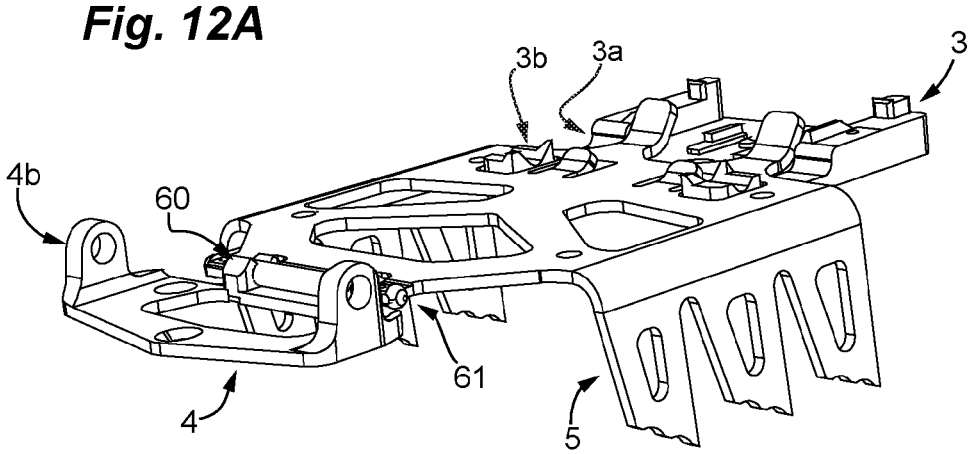
FIG. 12A illustrates the interdigitation of a toe pivot cradle, a pivotable crampon, and a heelblock, as enables their co-location in the limited clearance under the baseplate.

FIG. 12A illustrates the interdigitation of a toe pivot cradle 4, crampon hinge claw bracket 60, a pivotable crampon 5 and a heelblock 3 as enables their co-location in the limited clearance under the baseplate. Crampon hinge claw bracket 60 is a mount-in-place system for attaching the hinge axle of the crampon. Crampon hinge axle 61 is positioned so that the rear end of the crampon precisely aligns with flats on the rear heelblock 3. The top plate of the crampon is fenestrated to receive heelblock detent seat 3*a* and heelblock detent seat 3*b*. Tabs forming first and second detent seats on the crampon upper surface are also shown.

Figure 12B:
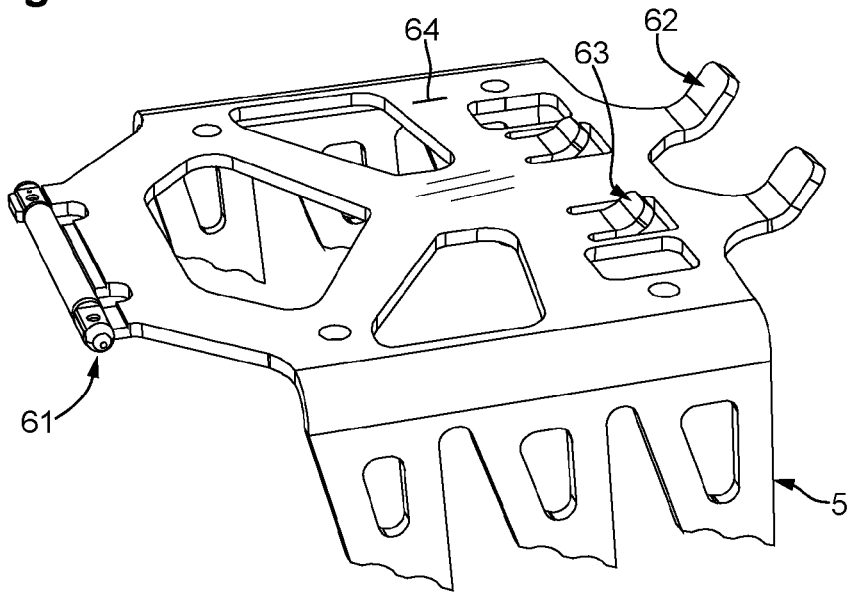
FIG. 12B is a detail view of a pivotable crampon configured for use with a climbing wire and heelblock of the invention.

FIG. 12B is a detail view of a pivotable crampon 5 configured for use with the climbing wire and heelblock of the invention. Shown are the crampon pivot axle 61, the first crampon detent 62, and the second crampon detent 63 formed as tabs on the top plate 64 of the crampon. The two detents are used in conjunction with the climbing wire to generate a plurality of angles at which the baseplate can be fixed. The crampon itself however, is generally not installed unless touring on frozen ground, ice, hard or crusty snow.

Figure 13A:
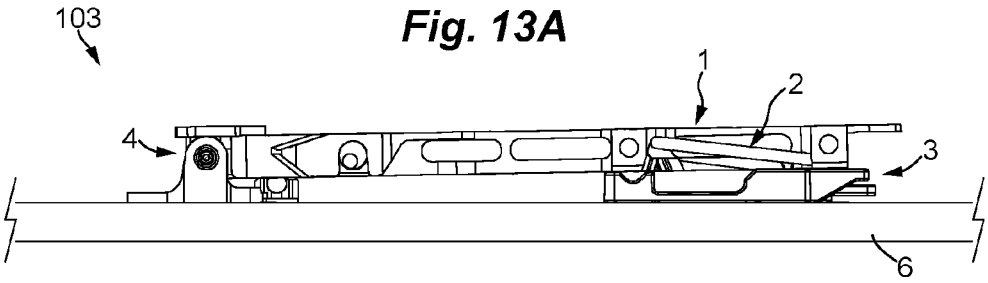
FIGS. 13A, 13B and 13C are perspective side views showing three positions of climbing wire deployment.
Figure 13B:
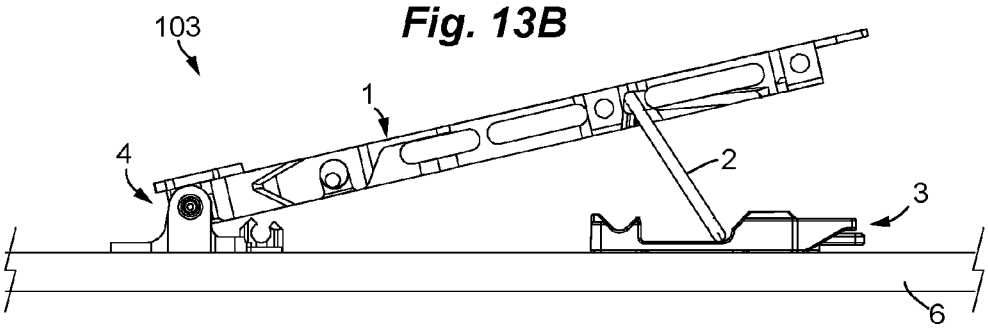
Figure 13C:
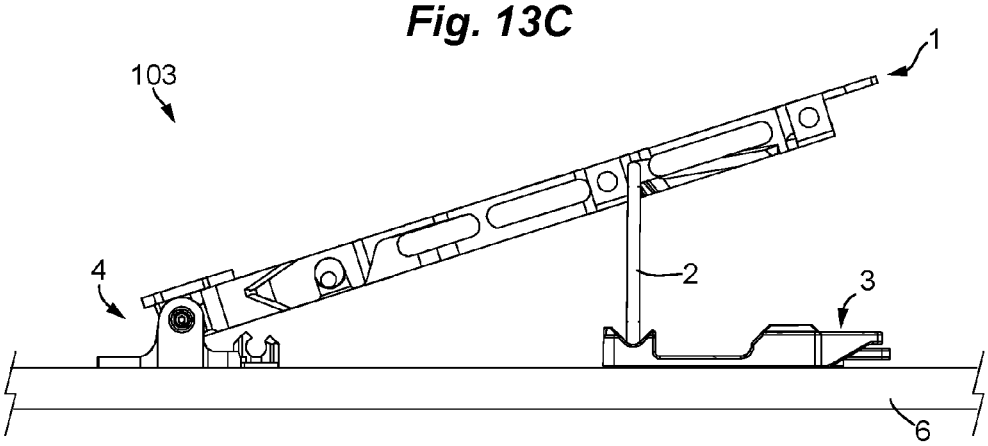

FIGS. 13A, 13B and 13C are perspective side views showing three positions of climbing wire deployment corresponding to the stowage position in the baseplate and two detent stations on a heelblock of an exemplary combination 103. Shown are a neutral position, a first detent position, and a second detent position on the heelblock corresponding to angles of about 1 degree, about 12-13 degrees, and about 18 degrees. As presently practiced, these are three useful angles for ski touring. As termed here, these are a "first detent" position, a "second detent" position, and a "third detent" position. While three detent positions are shown, this is not intended to be a limitation of the invention and these detents are depicted only as an example. Fewer or more detents may be provided. Each detent combination provides a unique angulation of the baseplate and heel height and selections are made based on product testing.

Figure 14A:
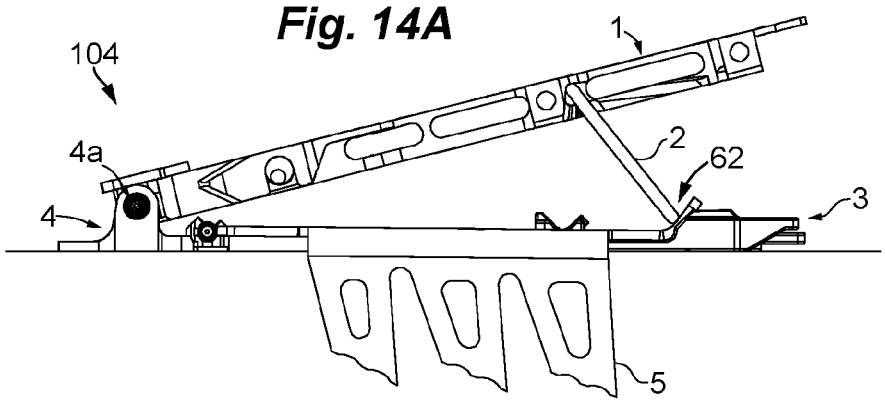
FIGS. 14A, 14B and 14C are perspective side views showing three positions of climbing wire deployment corresponding to two added detent stations with a crampon in place.
Figure 14B:
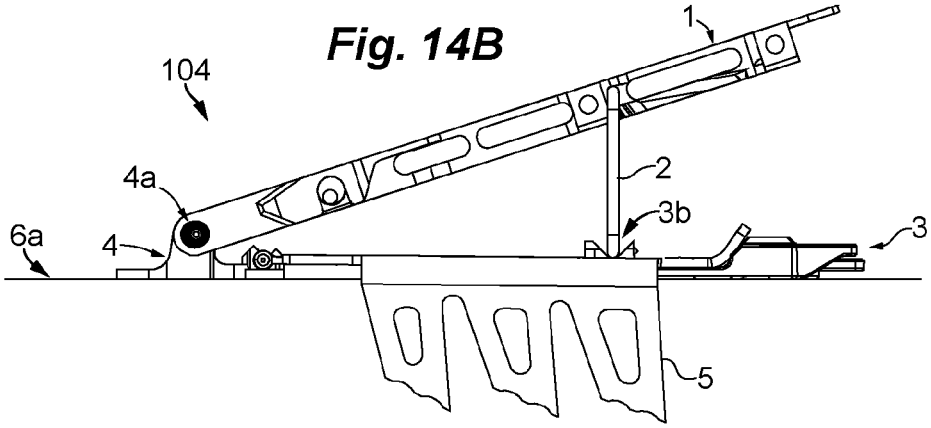
Figure 14C:
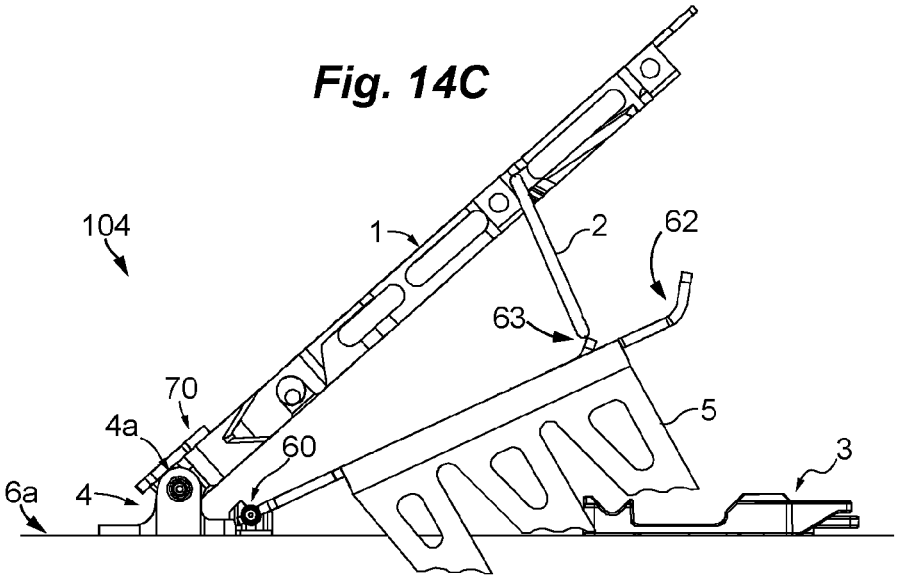

FIGS. 14A, 14B and 14C are perspective side views of an exemplary combination 104 showing multiple positions of climbing wire deployment corresponding to added detent stations with the crampon in place. Shown are a first detent position, a second detent position, and a dynamically elevated position on tabs on the raised plate of the pivotable crampon, such as when on hard ice. The crampon may also be used in the "neutral position" as corresponds to that shown in FIG. 13A with climbing wire stowed. With the climbing wire deployed on the crampon, angulations depicted here correspond about 14 degrees, about 18 degrees and up to about 42 degrees. The hinge action of the crampon is useful when engaging a hard icy surface or frozen ground such that the crampon does not penetrate. The hinging action of the crampon also makes it easier to slide an unweighted foot forward in ski tour mode before forcing the crampon into a frozen but yielding surface. As can be seen, toe pivot angle can be extreme, and is accomplished here with use of the toe pivot cradle 4 and toe pedal assembly 70 as described in U.S. Pat. No. 9,126,099, titled BOOT BINDING SYSTEM WITH FOOT LATCH PEDAL, which is co-owned and co-assigned. However, other toe pivot systems may also benefit.

Figure 15A:
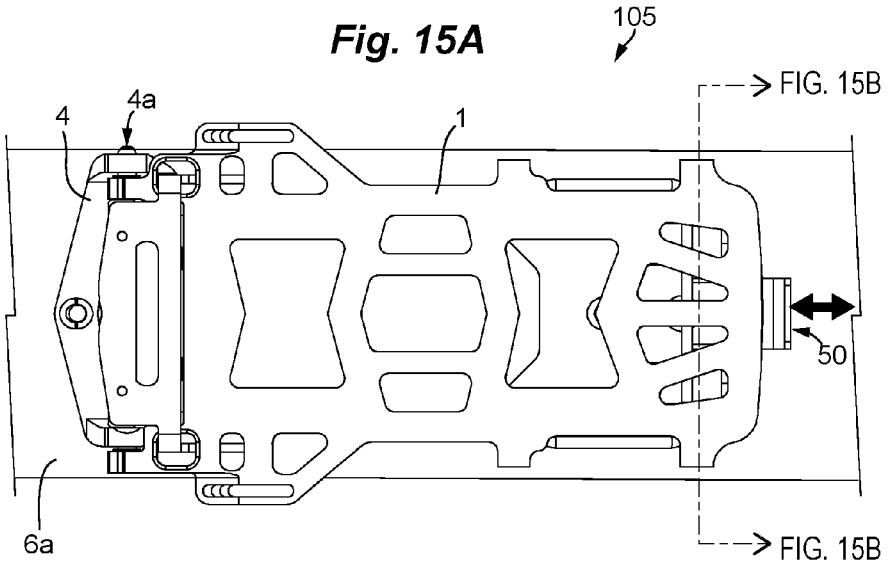
FIG. 15A is a plan view of a ski tour interface with heel lock, showing the section plane of the cut depicted in FIG. 15B, where the heel lock mechanism is isolated for clarity. Demonstrated in this view is a representative heel lock mechanism for lockingly engaging the underside flanges of the baseplate.
Figure 15B:
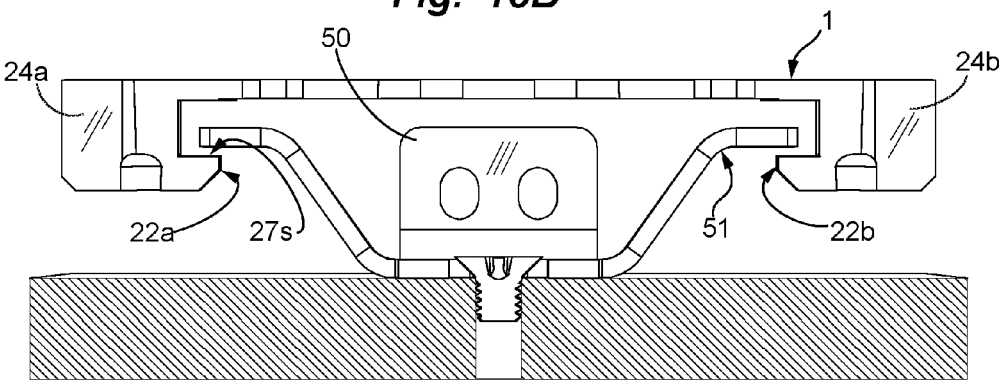

FIG. 15A is a plan view of a ski tour interface with heel lock combination 105, showing the section plane of the cutline depicted in FIG. 15B, where the heel lock mechanism is isolated for clarity. Demonstrated in this view is a heel lock mechanism for lockingly engaging the underside flanges of the baseplate 1. Each arm 51 of the heel lock slider 50 engages the upper shelf 27*s* surfaces of the inside wall flanges (22*a*,22*b*) to prevent the baseplate from being released under normal use. As presently practiced, the heel locker is slideably guided (bold arrow) by a channel on the underside of the heelblock. The locker slides back and forth between an engaged, locked position in which the spring arms 51 contact the upper surfaces 27*s* of the end stop flanges (24*a*,24*b*), and a disengaged freeheel position in which the spring arms are pulled back from the flange tip surfaces 27*s* so that the baseplate may pivot freely on the toe axis.

Figure 16:
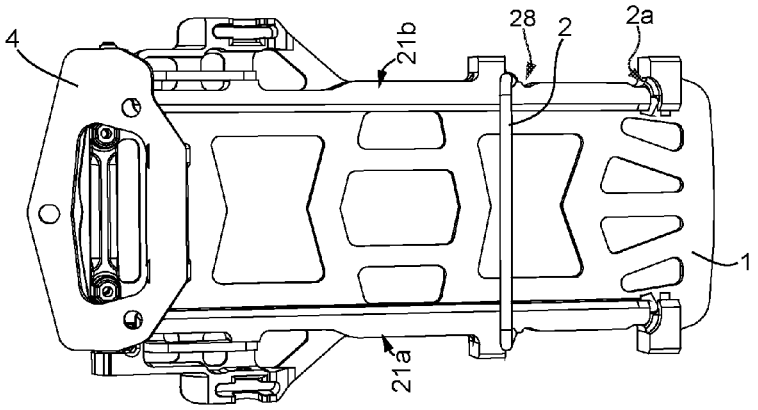
FIG. 16 is a perspective underside view of a splitboard boot binding with climbing wire deployed, showing the channel for stowing the climbing wire when not in use.

FIG. 16 is a perspective underside view of a splitboard boot binding with climbing wire deployed, showing stowage groove 2*a* used for stowing the climbing wire when not in use. The climbing wire has a spring constant, allowing it to be held in place in multiple positions. Visible is one of two small receiving pockets 28 on the outside edge of the baseplate, and a larger storage channel 2*a* in the rear flanged end of the lateral beam members (21*a*,21*b*).

Figure 17A:
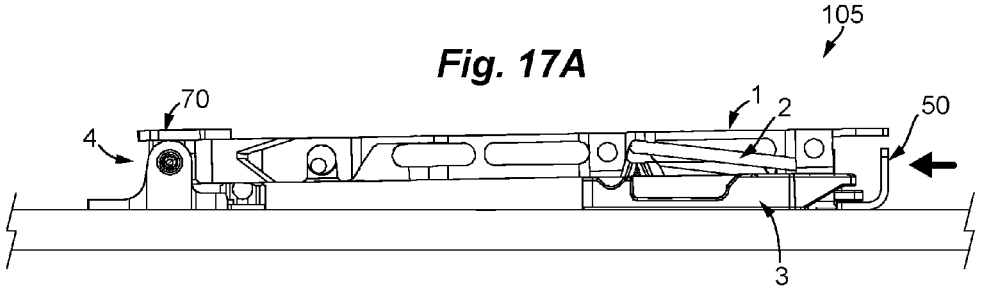
FIG. 17A is a side view of a ski tour interface with heelblock, the heelblock having a heel locking device for engaging and securing the baseplate in a fixed heel mode.
Figure 17B:
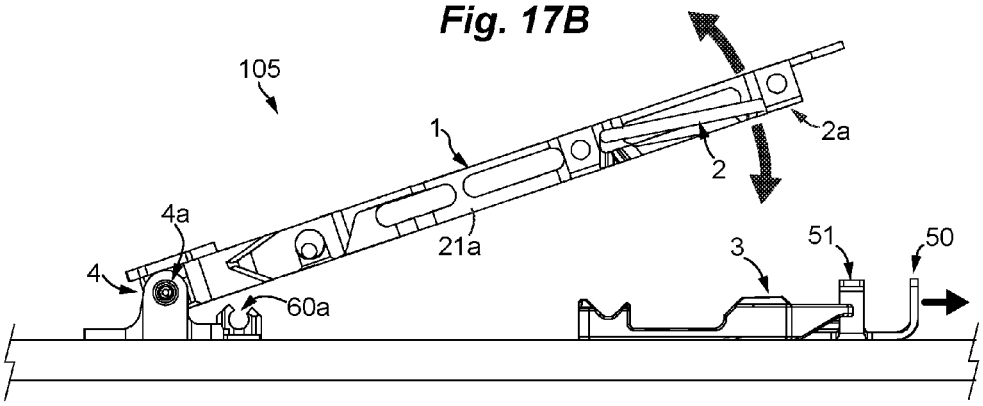
FIG. 17B shows the ski tour interface in free heel mode with climbing wire stowed.

FIG. 17A is a side view of a ski tour interface combination 105 with heelblock, the heelblock having a heel locking device for engaging and securing the baseplate in fixed heel ski tour mode. The bold arrow indicates that the heel lock slider 50 has been pushed "in" and engages the underside of the baseplate and the rider is in "heel lock mode". FIG. 17B shows the ski tour interface in "free heel mode" with the climbing wire stowed and the heel locker disengaged. The bold arrow indicates that the heel locker 50 has been pulled "out" and is disengaged from the underside of the baseplate. The spring arms 51 are free and the rider is in free heel mode.

Figure 18:
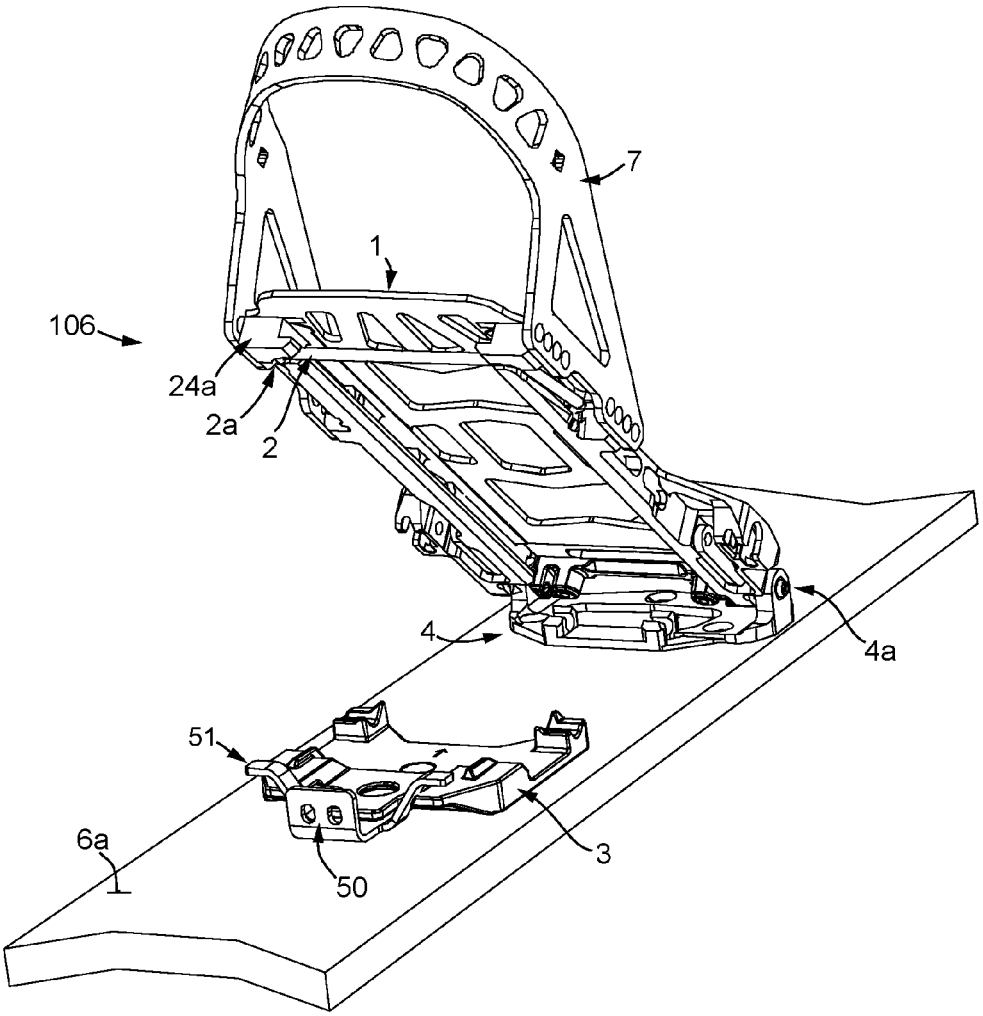
FIG. 18 demonstrates the compact stowage of the climbing wire in a combination including a heel lock mechanism. The boot binding is shown here in "free heel" mode.

FIG. 18 demonstrates the compact stowage of the climbing wire in a combination 106 including a heel lock slider 50 mechanism. The boot binding is shown here in "free heel" mode and the heel lock slider is in the disengaged position in a fitted channel under the heelblock 3. At the rear aspect of baseplate beam end stop 24*a*, the stowage position of climbing wire 2 in stowage channel 2*a* is shown. Also visible in this view is the back side of the toe pivot cradle 4 with hinge bracket for receiving a pivotable crampon. The climbing wire is configured not to interfere with the heel lock slider arms 51.

Figure 19:
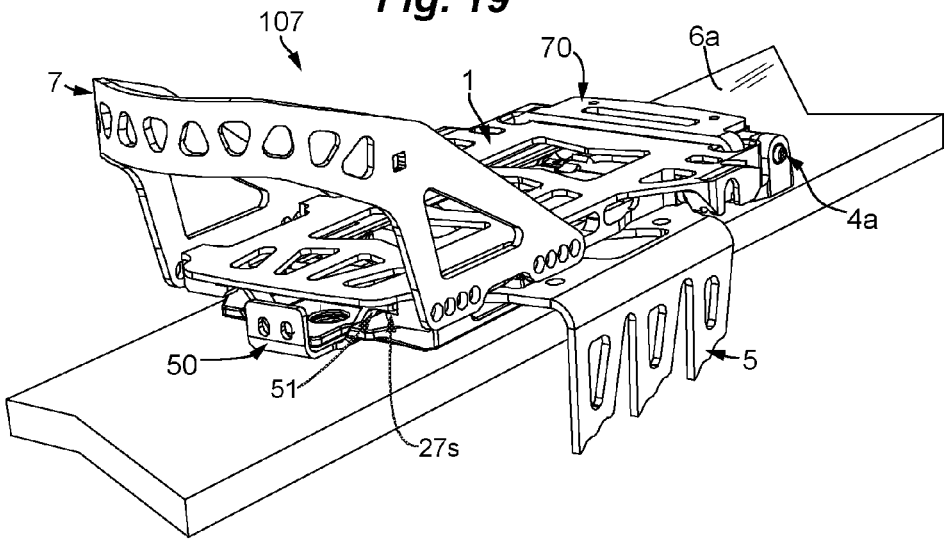
FIG. 19 demonstrates the compact stowage of the climbing wire in a combination including a heel lock mechanism. The boot binding is shown here in "locked heel" mode.

FIG. 19 demonstrates the compact stowage of the climbing wire in a combination 107 including a heel lock slider 50. The boot binding is shown here in "locked heel" mode, where the heel locking slider is pushed in so that spring arms 51 engage the upper shelf surfaces 27*s* of the flanged walls on the underside of the baseplate 1.

Figure 20:
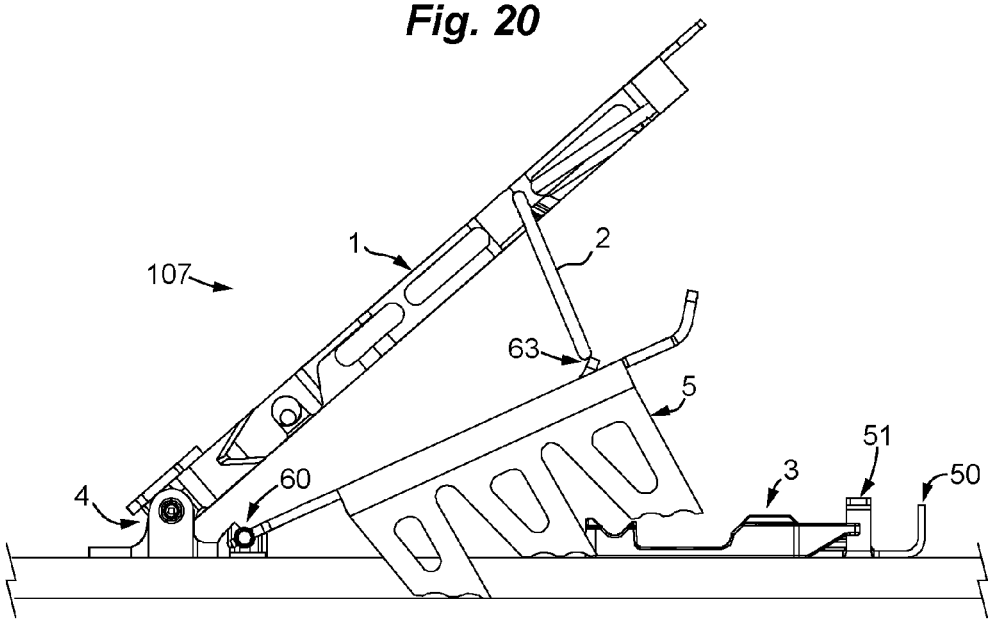
FIG. 20 is a side view demonstrating an angulated combination including a climbing wire, heel lock mechanism and a crampon.

FIG. 20 is a side view demonstrating an angulated combination 107 including a climbing wire, heel lock slider mechanism 50 and a crampon 5, where the climbing wire 2 is resting on the second detent position 63 of the crampon. Pivotability of the crampon at hinge claw bracket 60 ensures that unyielding, frozen surfaces can be attacked by a determined climber.

Figure 21A:
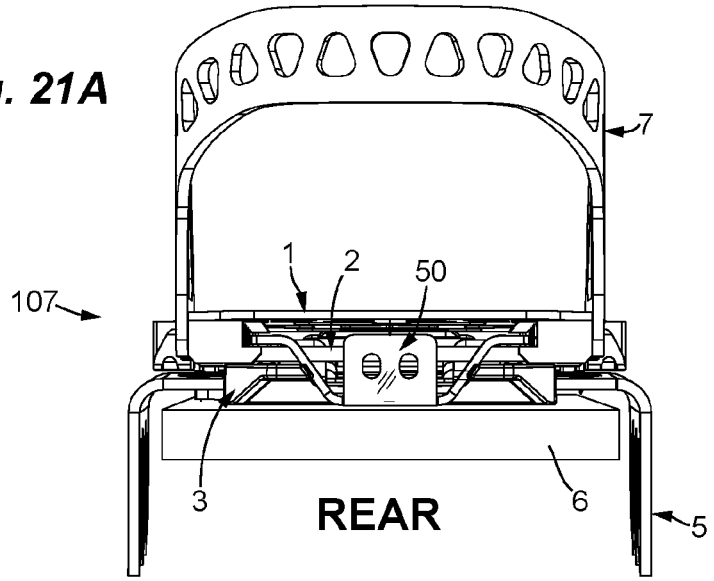
FIGS. 21A and 21B are rear and front views of the climbing wire and heelblock assembly with crampon and heel locking mechanism.
Figure 21B:
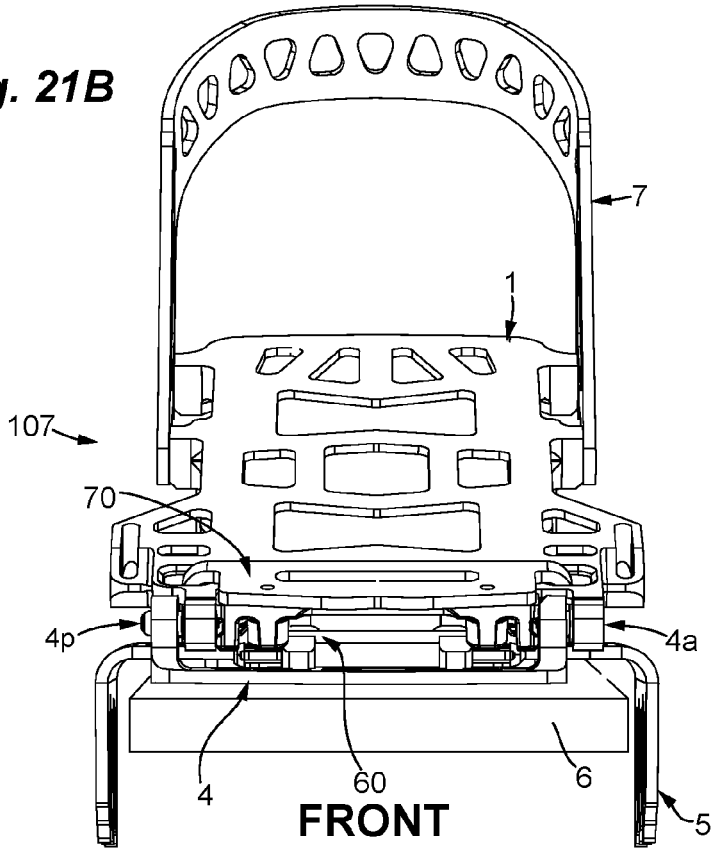

FIGS. 21A and 21B are front and rear views view of the climbing wire and heelblock assembly with crampon and heel lock slider 50 mechanism as a combination 107 with a ski tour interface. In REAR view FIG. 21A shows that the heelblock 3 with locker 50, crampon 5 and climbing wire 2 occupy a tight constellation of positions at the rear end of the baseplate 1, such that when the boot binding is exchanged onto the ride mode condition, the pucks slide in from the toe, and there is no interference between the climbing wire and the pucks. The crampon 5 of course is removed for ride mode. The rider's stance in ride mode is somewhat crosswise on the board versus, in ski tour mode, is aligned with the long axis of the ski half members.

From the FRONT, the pivot ears of the baseplate are shown to engage corresponding pivot ears (4*a*,4*b*) of the toe pivot cradle 4 so as to lock the baseplate onto the toe pivot axis. As currently practiced, a toe latch pedal 70 mechanism is central in locking the baseplate to toe pivot pins 4*p* disposed ipsilaterally on each of the toe pivot ears. Details of the toe pivot mechanism are disclosed in U.S. Pat. No. 9,126,099 to Ritter, but the spirit and scope of the invention is not limited thereto. In this view, the hinge axle and crampon hinge claw bracket 60 is also shown.

Figure 22:
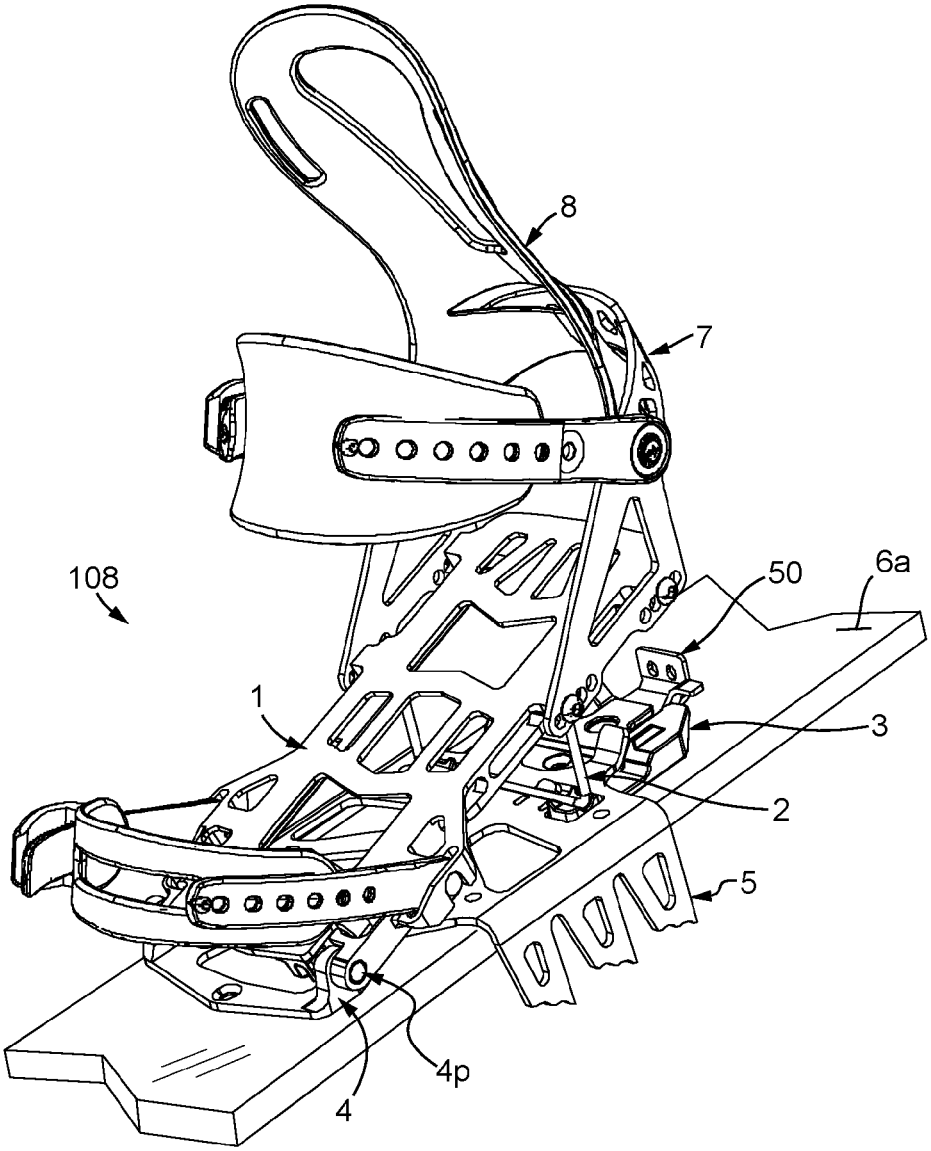
FIG. 22 is a perspective view of a complete splitboard boot binding combination with highback, heel loop, straps, snap ramp, heelblock, climbing wire, crampon and heel locking mechanism.

FIG. 22 is a perspective view of an improved splitboard boot binding with "snap ramp" toe pivot cradle 4 with pivot pins 4*p*, heelblock 3, climbing wire 2, crampon 5, and heel locking mechanism 50 in combination 108 with a ski tour interface. Other toe pivot brackets, heelblocks and climbing wires may be readily conceived, while not departing from the spirit of the invention, upon absorbing the teachings disclosed here.

Figure 23:
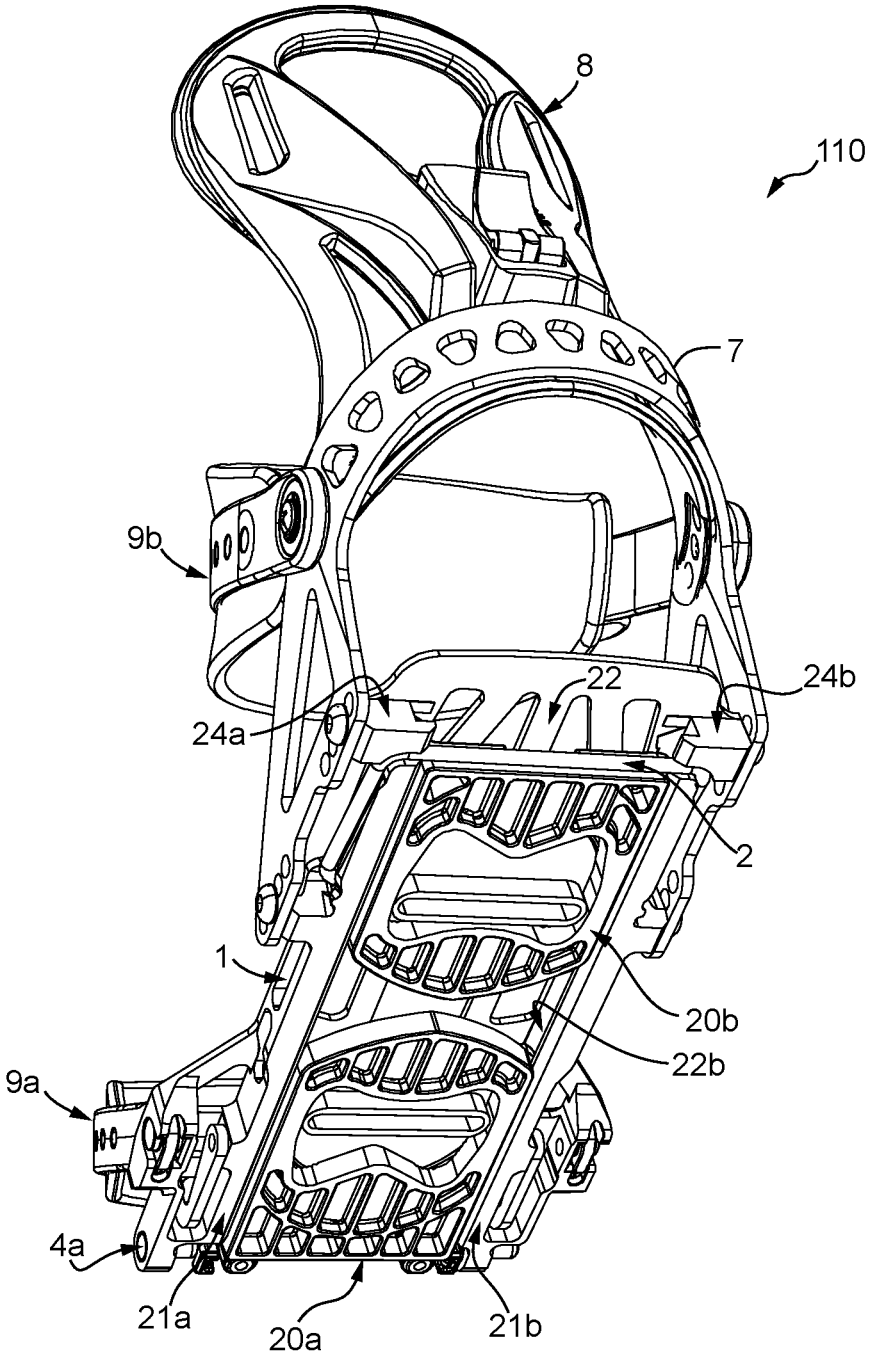
FIG. 23 is an underside view of a splitboard boot binding combination. The heelblock is not shown so that the underside channel in the baseplate is emphasized. For reference, a pair of pucks is shown, such as may be used in a ride mode interface, demonstrating how the splitboard ride mode interface dictates stringent use of the limited space under the baseplate and in the truss beams of the baseplate.

FIG. 23 is an underside view of a baseplate and ride mode interface combination 110. The underside channel 22 is defined by lateral truss beams (21*a*,21*b*) and interior underside flanges 22*b*. A double-headed arrow identifies the channel in FIG. 3, prior to insertion of the pucks. In FIG. 23, a pair of flanged pucks (20*a*,20*b*, also termed a "slider track" in the art) are shown slideably mounted in the flanged channel 22 (without the board). In actual use, the pucks are secured to the ski members of a splitboard so that they can be conjoinedly and flangedly interlocked in the ride mode configuration. Pucks are known in the art, for example as described in U.S. Pat. No. 5,984,324, but are not limited to such. They have been re-engineered here for example as described in U.S. patent Ser. No. 14/981,777, filed 28 Dec. 2015, titled "PUCK SYSTEM". To form a ride mode interface, paired pucks are proximately positioned on the opposing ski members, forming a "slider track" to receive a boot binding baseplate traversing and joining the two ski members into a rigid solid board for the downhill ride; thus the term "ride mode interface". To engage the ride mode interface, the boot binding underside channel 22 slides onto mating flanges on the pucks and is locked in place at the toe and heel.

The climbing wire 2 is shown in a neutral (stowed, undeployed) detent position and wraps around the back of puck 20*b* so as to retain the pucks in channel 22 at the heel. However, when the binding is removed from the pucks (by releasing the toe latch pedal), the climbing wire can be pivoted into one of the detent positions in ski touring mode as shown earlier. Surprisingly, with this convergence of structures having dual functions, the climbing wire is demonstrated to pivot in ski tour mode and to retain the pucks in ride mode, as will be described below.

The figure also demonstrates how the ride mode interface dictates stringent use of the limited space under the baseplate, which is filled almost entirely by the pucks. The climbing wire and the pucks are co-located under the baseplate in ride mode, eliminating the need for installing a climbing wire or bar when switching to ski tour mode. Also shown in this view of the boot binding are heel cup 7, highback 8, ankle strap 9*b* and toe strap 9*a*, all of which are mounted on baseplate 1.

Figure 24A:
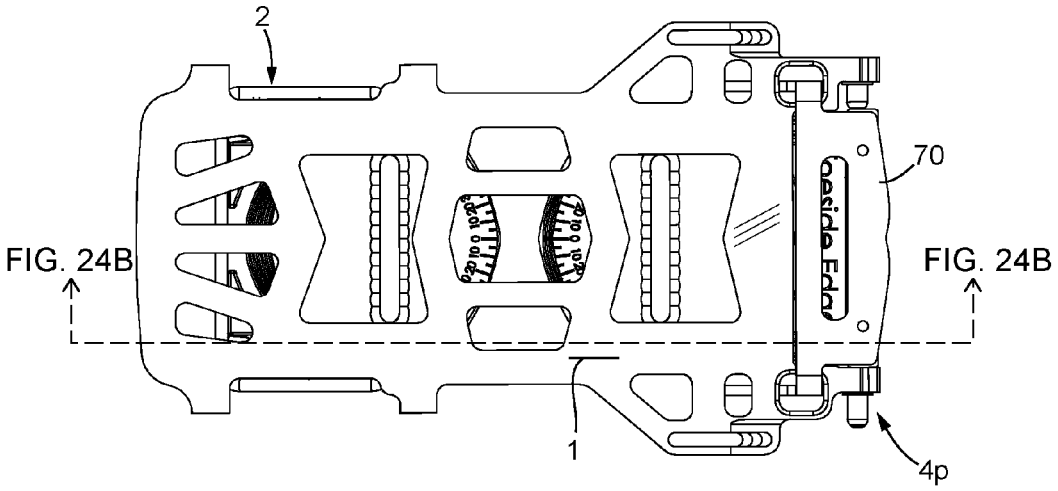
FIGS. 24A, 24B and 24C are views of a boot binding baseplate in which the novel climbing wire functions to retain a pair of pucks at the heel end, as for securing the boot binding baseplate to a ride mode interface. Details of a toe-end retaining posts are also shown.
Figure 24B:
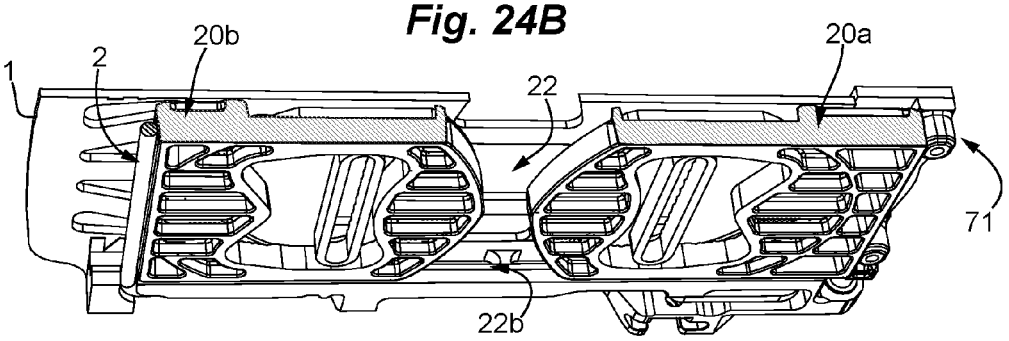
Figure 24C:
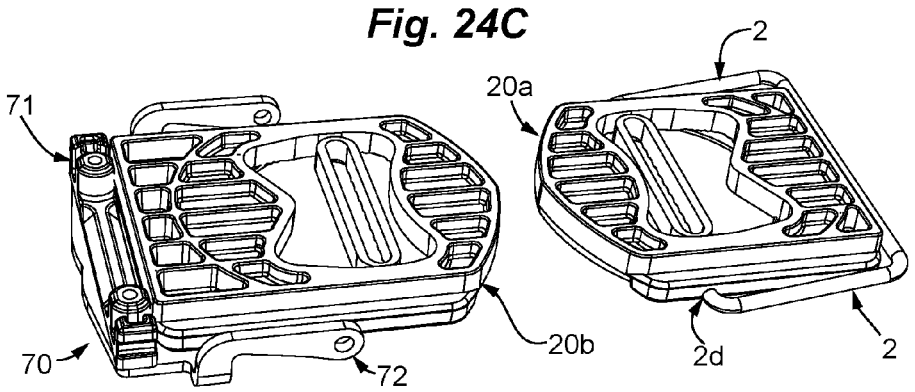

FIGS. 24A and 24B are plan and perspective views of a boot binding baseplate 1 in which the novel climbing wire functions to retain a pair of pucks at the heel end, as when securing the boot binding baseplate to a ride mode interface in this combination. At the toe end, retaining posts 71 retain the pucks in the channel 22 and are part of the toe latch pedal mechanism 70. FIG. 24A is a topside view of a boot binding baseplate with ride mode interface partially concealed underneath. The climbing wire 2 is seen stowed at the heel end. FIG. 24B shows a cross-sectional cut through the pucks (20*a*,20*b*). Also cut in cross-section is the climbing wire 2, which is shown tightly pressed against the heel puck 20*b* by the action of toe latch pedal posts 71. Essentially the pucks are captured by an interference fit between the climbing wire 2 at the heel and the toe latch pedal posts 71 at the toe, which may be pressed into place by the weight of the rider's boot atop latch pedal 70. This is an advance in the art, speeding the process of switching from ski tour mode to ride mode, and substantially reducing looseness on the ride mode interface. Thus modifications in the ski tour interface result in an unexpected improvement in the ride mode performance. FIG. 24C is an underside view of the pucks pressed between the toe posts 71 and the climbing wire 2 at the heel. Other parts of the baseplate are not shown for clarity. The hinge 72 relates to toe latch pedal action. Details of the operation of the toe latch pedal are described in U.S. Pat. No. 9,126,099 to Ritter, which is co-owned and assigned, and is incorporated here by reference for all it teaches. The pivot end 2*d* of the climbing wire is also shown in this view.

Figure 25A:
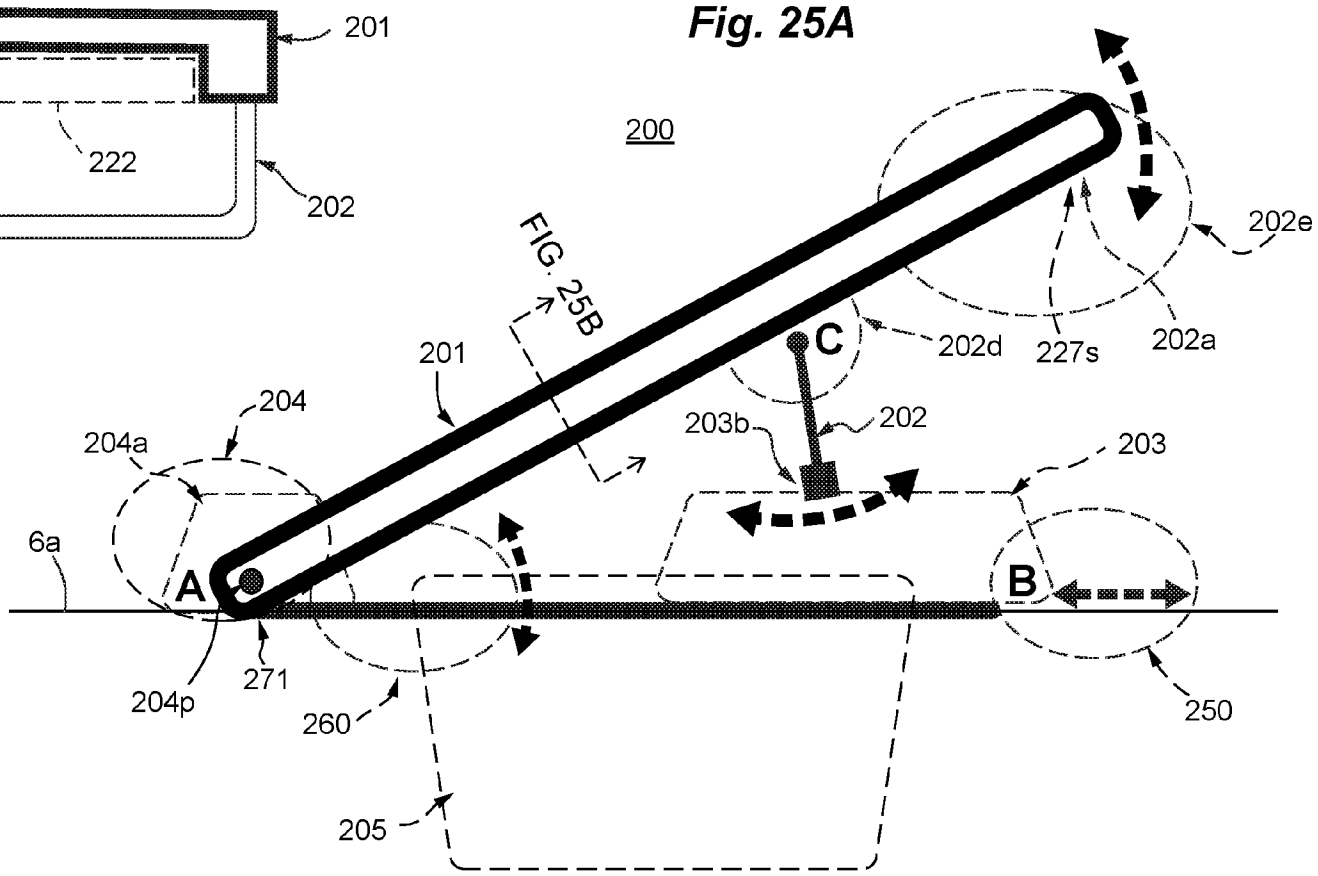
FIG. 25A is a schematic view of the combinations and sub-combinations of the invention for use with a ski tour interface.

FIG. 25A is a schematic view of the combinations and sub-combinations of the invention for use with a ski tour interface. Shown is a general baseplate 201, where "general" indicates generality of structure without detail or particulars except as needed to perform cooperative functions with other members of a combination or sub-combination. Also shown are indications of a general single multiposition climbing wire 202 with pivot mount; a general climbing wire stowage channel 202*a*; a general climbing wire pivot mount 202*d*; a general heel lock engagement device 202*e* on the underside of the baseplate; a general heelblock structure 203; a general detent position on a heelblock 203*b* representative of a plurality of such detent positions; a general toe pivot bracket or "block" 204; a general toe pivot ear 204*a* as part of a toe pivot bracket or cradle for pivoting the baseplate on a toe pivot pin 204*p* system or axle; a general slide-on crampon 205 with hinge; a general underside channel 222 with flanges for engaging a slider track (pucks 20*a*,20*b*); a general heel locker for engaging flange surfaces 227*s*; a general heel locker mechanism 250 in the heelblock; and an indication of a general crampon hinge claw bracket 260 without particulars. The components of a splitboard boot binding may be combined in a variety of sub-combinations. The toe pivot cradle may include a hinge claw bracket for hinge mounting a slide-on crampon; the toe pivot axis may include a latch pedal mechanism; the baseplate may include a pivotable climbing wire; the heelblock may include a plurality of detents for seating a climbing wire; the heelblock may include a heel locker mechanism, and, the baseplate may include a stowage channel for securing a climbing wire when not deployed, such that the climbing wire does not interfere with use of the baseplate on a slider channel in ride mode. The climbing wire may also be used to secure the slider channel at the heel in ride mode, while being used in ski tour mode to angulate the baseplate in combination with detents in the heelblock or in combination with detents on the top plate of the crampon. In one embodiment, all of the components may be used in combination, where each component operates cooperatively with other components in either ride mode, ski tour mode, or both ride mode and ski tour mode. Only the toe pivot support and the heel support are physically attached to the board surface 6*b* by threaded fasteners. All other connections are made by the parts themselves and are fully attachable and detachable without tools. No limit is placed on the nature of the connections except that parts that engage are mechanically mated so as to seat or interlock where desirable and not to interfere with each other's functions in the ski tour mode, ride mode, or in some instances, result in no interference in both modes, such as the boot binding baseplate 201, heelblock 203, and toe "block" 204, which are common to all configurations.

Thus in preferred embodiments, the invention is an improved splitboard boot binding with ski tour interface comprising in combination a) a boot binding baseplate 201; b) a toe pivot cradle with toe pivot axis 204; c) a heelblock 203; d) a climbing wire 202; e) a crampon 205; and f) a heel locker 250; wherein the boot binding baseplate 201 is pivotably mounted on the toe pivot pins 204*p*, the heelblock 203 and the toe pivot cradle 204 are affixed to a ski member of a splitboard, the climbing wire 202 is pivotably pinned to the underside of the boot binding baseplate 201, the crampon 205 hingedly seats into a hinge claw bracket 260 posteriorly disposed on the toe pivot cradle 204, and the heel locker 250 is slideably mounted within the heelblock 203, the block having a plurality of detents configured to receive the climbing wire in support of the baseplate in a plurality of elevated positions.

For example, a first sub-combination includes a ski tour interface with modified heelblock 203 having a heel locker 250 and a boot binding baseplate 201 having a single pivotable climbing wire 202, wherein the heelblock is also provided with multiple detents for seating the climbing wire at a plurality of angulations.

A second sub-combination includes a ride mode interface with a pair of pucks (slider track not shown) fastened to a splitboard at 6*a* and a boot binding baseplate 201 with underside channel for engaging the slider track, a toe pedal latch mechanism 204 having toe latch pedal posts 271 at the toe end and a climbing wire 202 configured to capture the pair of pucks of the slider track at the heel end.

A third sub-combination includes a slide-on hinged crampon 205 in combination with a toe pedal latching mechanism 204 such that the slide-on crampon is mounted on the toe pivot cradle by a hinge claw bracket 260.

A fourth sub-combination includes a hinged slide-on crampon 205 with hinge claw bracket 260 at a toe end and a crampon top plate having a plurality of detents (not shown) for seating a climbing wire 202, wherein the detents operate cooperatively with detents on a heelblock.

A fifth sub-combination that includes an internal flanged underside channel (222, FIG. 25B) in a pivotable baseplate 201, the flanged truss beams of the channel for engaging a slider track in ride mode and the flanged end surfaces 227*s* for engaging a heel locker mechanism 260 in ski tour mode.

Figure 25B:
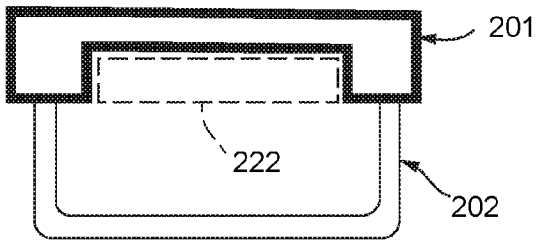
FIG. 25B is a schematic view of the boot binding baseplate in cross-section, showing the climbing wire in a deployed position and the underside channel space reserved for the ride mode interface. While only one interface, ride mode or ski tour mode, can be used at a time, the splitboard boot binding system of the invention permits rapid and reversible interchange of the boot binding between the two interfaces.

FIG. 25B is a schematic view of the boot binding baseplate 201 in cross-section (cut line essentially as shown in FIG. 25A), showing a climbing wire 202 hingedly deployed position and an underside channel space 222 reserved for the ride mode interface. While only one interface, ride mode or ski tour mode, can be used at a time, the splitboard boot binding system of the invention permits rapid and reversible interchange of the boot binding between the two interfaces. In this instance, the climbing wire acts to close the heel end of the underside channel space 222 in ride mode, but also pivots down in ski tour mode to angulate the baseplate heel end, and requires no tools for its operation. Similarly, the toe pivot latch mechanism and heel locker mechanism function without tools, providing the rider with an essentially worry-free experience where all adjustments can be made with a ski pole, a gloved hand, or the toe of a boot.

The splitboard boot binding combinations disclosed here offer multiple functions in a compact package. Riders may chose from multiple baseplate angles by selecting a suitable climbing wire/detent combination. At any time, riders may also readily deploy and use a crampon or a heel lock, depending on their preference and trail conditions. Also offered is a "snap ramp", also termed "toe latch pedal mechanism" 70, that makes possible rapid shifts from ride mode to ski tour mode, and back. Shown in FIG. 1 and FIG. 23 of complete binding assemblies for a ski tour interface or a ride mode interface are a highback 8 and toe and ankle straps (9*a*,9*b*) as are conventional or a splitboard boot binding. All these are attached directly to the boot binding baseplate 1 or to the heel loop 7 so as to minimize excess weight and the parts count.

While not shown, a climbing skin may also be used in combination with the various combinations of the invention, improving the rider's capacity to 'ski uphill' with reduced effort. Brackets at the ends of the climbing skins are used to attach the skins to the tips of the half ski ends. All such components are compatible with other components of the ski tour mode.

The invention may also be characterized as a method, which comprises steps for adjusting heel height of a boot binding baseplate using a single climbing wire and multiple detents when splitboarding in ski touring mode. By using multiple detents in a heelblock and optional multiple pivot axes for mounting a climbing wire on lateral walls of the baseplate, a fine level of control of the climbing angle is provided, as is advantageous in conserving strength when climbing. Also helpful is the capacity to combine other functional units in a fully inter-compatible lightweight and compact package with crampon and heel locking mechanism. Cooperative improvements in function are achieved by combining structures as shown. Clipping the crampon onto the toe pivot cradle reduces parts, the heelblock improves the function of the toe pivot, so that the rider's foot is generally level when in the neutral position, and the pieces of the combinations are adapted so that they may be assembled and disassembled in various combinations and sub-combinations without tools or detachable fasteners. Thus by trial and error, improved boot binding, ride mode and ski tour interface systems are achieved that combine structural elements into a compact and lightweight whole having a synergy in function while retaining the unique capacity of splitboarding, the interchangeability of ski tour and ride modes.

While the emphasis on this disclosure is on splitboard boot binding systems for use with ski tour mode interface combinations, the systems are fully compatible with ride mode interface combinations as well, so as to enable splitboarding. However, the ride mode interface is mounted separately on the splitboard. A fully assembled splitboard in ride mode configuration is not shown but may be understood by study of U.S. Pat. Nos. 5,984,324, 7,823,905, 8,226,109 and in US Pat. Doc. No. 2013/025395, all of which are incorporated herein in full by reference.

INCORPORATION BY REFERENCE

All of the U.S. Patents, U.S. Patent application publications, U.S. Patent applications, foreign patents, foreign patent applications and non-patent publications referred to in this specification and related filings are incorporated herein by reference in their entirety for all purposes.

SCOPE OF THE CLAIMS

The disclosure set forth herein of certain exemplary embodiments, including all text, drawings, annotations, and graphs, is sufficient to enable one of ordinary skill in the art to practice the invention. Various alternatives, modifications and equivalents are possible, as will readily occur to those skilled in the art in practice of the invention. The inventions, examples, and embodiments described herein are not limited to particularly exemplified materials, methods, and/or structures and various changes may be made in the size, shape, type, number and arrangement of parts described herein. All embodiments, alternatives, modifications and equivalents may be combined to provide further embodiments of the present invention without departing from the true spirit and scope of the invention.

In general, in the following claims, the terms used in the written description should not be construed to limit the claims to specific embodiments described herein for illustration, but should be construed to include all possible embodiments, both specific and general, along with the full scope of equivalents to which such claims are entitled. Accordingly, the claims are not limited in haec verba by the disclosure.

KEY TO THE FIGURES

| | |
|---|---|
| baseplate | 1 |
| climbing wire | 2 |
| climbing wire stowage channel | 2a |
| climbing wire mount | 2d |
| heelblock | 3 |
| first detent | 3a |
| second detent | 3b |
| toe pivot cradle | 4 |
| toe pivot ears | 4a, 4b |
| toe pivot axis | 4c |
| toe pivot pin | 4p |
| pivotable crampon | 5 |
| ski member | 6 |
| top surface of ski member | 6a |
| heel cup | 7 |
| highback | 8 |
| binding straps | 9a, 9b |
| pucks | 20a, 20b |
| underside truss beams | 21a, 21b |
| underside center channel space | 22 |
| underside flanged walls | 22a, 22b |
| end stop flanges | 24a, 24b |
| flange upper shelf of end stop flanges | 27s |
| lateral detent for climbing wire | 28 |
| underside volume and clearance | 40 |
| slideable heel locking mechanism | 50 |
| heel locking spring members | 51 |
| crampon hinge claw bracket | 60 |
| crampon hinge claw | 60a |
| crampon hinge axle | 61 |
| first crampon detent | 62 |
| second crampon detent | 63 |
| toe latch pedal assembly | 70 |
| toe latch pedal posts | 71 |
| splitboard boot binding assembly with ski touring interface combination | 100 |
| First combination | 101 |
| Second combination | 102 |
| Third combination | 103 |
| Fourth combination | 104 |
| Fifth combination | 105 |
| Sixth combination | 106 |
| Seventh combination | 107 |
| Eight combination | 108 |
| Second splitboard boot binding assembly with ski touring interface combination | 110 |
| General baseplate | 201 |
| General single multiposition climbing wire | 202 |
| Climbing wire stowage channel | 202a |
| General climbing wire pivot mount | 202d |
| General heel locking system | 202e |
| General heelblock | 203 |
| General detent position on heelblock | 203b |
| General toe pivot bracket | 204 |
| General toe pivot ear | 204a |
| General toe pivot pin | 204p |
| General slide-on crampon | 205 |

-continued

| | |
|---|---|
| General slider channel receiving space | 222 |
| Heel locker flange surfaces | 227s |
| General heel locker | 250 |
| General crampon hinge bracket | 260 |

I claim:

1. An improved splitboard boot binding and ski tour interface system comprising in combination a) a boot binding baseplate with toe end and heel end;

b) a toe pivot cradle with toe pivot axis;

c) a heelblock;

d) a climbing wire;

e) a crampon;

f) a heel locker;

wherein said heelblock and said toe pivot cradle are affixed to a ski member of a splitboard; said boot binding baseplate is pivotably mounted on said toe pivot axis; said climbing wire is pivotably pinned to the underside of said boot binding baseplate; said crampon hingedly slides onto a hinge claw bracket posteriorly disposed on said toe pivot cradle; and, said heel locker is slideably mounted in said heelblock, said heelblock having a plurality of detents configured to seatedly receive said climbing wire in support of said baseplate at said heel end in a plurality of elevated positions.

2. The system of claim 1, wherein said plurality of detents on said heelblock are configured to seatedly receive said climbing wire in support of said baseplate in two or more elevated positions thereon.

3. The system of claim 1, wherein said heel locker is positionable between a heel lock mode position and a free heel mode position.

4. The system of claim 1, wherein said baseplate comprises a stowage channel for receiving said climbing wire when in an undeployed position.

5. The system of claim 1, wherein said baseplate is fitted with a heel loop, a highback, a toe strap and an ankle strap.

6. A splitboard boot binding and ski tour interface system comprising in combination a) a boot binding baseplate with toe end and heel end;

b) a toe pivot cradle with toe pivot axis and toe pivot ears;

c) a heelblock;

d) a pivotable climbing wire; wherein, i) said heelblock and said toe pivot cradle are configured to be affixed to a ski member of a splitboard;

ii) said baseplate is configured to be pivotably mounted at said toe end to said toe pivot axis on said toe pivot ears;

iii) said climbing wire is U-shaped, having two legs, wherein said legs are conjoined at a bottom thereof by a base segment and are each pivotably attached at a top thereof to an underside wall of said baseplate; and, iv) said heelblock comprises a platform surface configured to support said heel end of said baseplate in a neutral position, said platform surface further having a plurality of detents configured to seatedly receive said climbing wire in support of said baseplate at said heel end in a plurality of elevated positions.

7. The system of claim 6, wherein said baseplate comprises a stowage channel for receiving said climbing wire in an undeployed position.

8. The system of claim 6, wherein each said leg of said climbing wire is springedly pinned in a pivot mount on said baseplate, and further wherein said pivot mount comprises one or more pivot positions.

9. The system of claim 6, further comprising a detachably attachable crampon, said crampon comprising a frontward aspect configured with a hinge axle mountable on a hinge claw bracket disposed on said toe pivot cradle behind said toe pivot ears and a rearward aspect configured to be disposed on top of the heelblock and used in conjunction with said climbing wire.

10. The system of claim 9, wherein said crampon comprises a top surface having one or a plurality of detents; wherein said one or a plurality of detents are configured to seatedly receive said climbing wire in support of said baseplate at said heel end in one or a plurality of elevated positions on said crampon.

11. The system of claim 6, further comprising a heel lock disposed in said heelblock, said heel lock having at least one locking arm configured to reversibly engage an underside flange of said baseplate, thereby enabling a heel lock mode and a free heel mode.

12. The system of claim 6, said baseplate is fitted with a heel loop, a highback, a toe strap and an ankle strap.

13. A splitboard boot binding and ski tour interface system comprising in combination a) a boot binding baseplate with toe end and heel end;

b) a toe pivot cradle with toe pivot axis and toe pivot ears;

c) a pivotable climbing wire having a deployed position and an undeployed position;

d) a detachably attachable crampon with top surface comprising one or a plurality of detents;

wherein i) said toe pivot cradle is configured to be affixed to a ski member of a splitboard;

ii) said boot binding baseplate is configured to be pivotably mounted on said toe pivot axis of said toe pivot cradle;

iii) said climbing wire is U-shaped, having two legs, wherein said legs are conjoined at a bottom thereof by a base segment and are each pivotably attached at a top thereof to an underside wall of said baseplate; and, iv) said toe pivot cradle comprises a hinge claw bracket for receiving said detachably attachable crampon such that said hinge claw bracket is configured to enable said crampon to pivot; and, v) further wherein said one or a plurality of detents are configured to seatedly receive said climbing wire in support of said baseplate at said heel end in one or a plurality of elevated positions on said crampon.

14. The system of claim 13, further comprising a heel locker disposed in said heelblock, said heel locker having at least one locking arm configured to reversibly engage said underside surface of said baseplate when moved from a first position to a second position, thereby enabling a heel lock mode and a free heel mode for use with said crampon.

15. The system of claim 13, wherein said crampon is disposed between said baseplate and said heelblock, and said climbing wire is configured to support of said baseplate in an elevated position relative to said pivotable crampon.

16. A splitboard boot binding system with ski tour mode interface and ride mode interface, the ski tour mode interface having a pair of toe pivot cradles, the ride mode interface having a pair of pucks for each foot of a rider, which comprises in combination:

a) a boot binding baseplate with toe end, heel end, foot support surface, and underside surface with underside wall, wherein said toe end of said boot binding baseplate is configured to be hingedly received in a toe pivot cradle in ski tour mode;

b) a single climbing wire pivotably affixed at a pivot mounting position on said underside wall of said boot binding baseplate;

c) a heelblock having a platform surface configured to receive said underside surface of said baseplate in a neutral position thereon; and, further wherein said platform surface comprises a plurality of detents thereon; such that said detents are each configured to seatably receive said single climbing wire when pivotedly deployed in support of said baseplate in a plurality of elevated positions.

17. The system of claim 16, wherein said climbing wire is springedly pinned in said pivot mounting position on said underside wall of said baseplate.

18. The system of claim 16, wherein said baseplate comprises a stowage channel for receiving said climbing wire when in an undeployed position.

19. The system of claim 18, wherein said climbing wire is U-shaped, having two legs, wherein said legs are conjoined at a bottom thereof by a base segment, and is configured to contactingly wrap around a heel end of a heel puck of a ride mode interface in ride mode.

20. The system of claim 16, further comprising an attachably detachable crampon with top surface having one or a plurality of detents;

wherein a hinge claw bracket disposed posteriorly on the toe pivot cradle is configured to receive said crampon, said crampon is configured to pivot on said hinge claw bracket, and to seat on said platform surface of said heelblock in a neutral position; and, further wherein said one or a plurality of detents on said crampon are configured to seatedly receive said climbing wire in support of said baseplate at said heel end in one or a plurality of elevated positions.

21. The system of claim 20, wherein said plurality of detents on said heelblock and said one or a plurality of detents on said crampon support three or more elevated positions of said heel end of said baseplate in ski tour mode.

22. The system of claim 16, further comprising a heel locker disposed in said heelblock, said heel locker having at least one locking arm configured to reversibly engage said underside surface of said baseplate when moved from a first position to a second position, thereby enabling a heel lock mode and a free heel mode for ski touring.

23. The system of claim 22, wherein said climbing bar is operable on said baseplate in a plurality of elevated positions of said heel end in said free heel mode and is operable to lockably secure said heel end of said baseplate to said ride mode interface in ride mode.

24. The system of claim 16, wherein said heelblock contains a toolbox under said platform surface.

25. The system of claim 16, wherein said heelblock detents support two or more elevated positions for said climbing bar in ski tour mode.

26. The system of claim 16, wherein said baseplate is fitted with a heel loop, a highback, a toe strap and an ankle strap.

* * * * *